US009269297B2

(12) United States Patent
Kanda et al.

(10) Patent No.: US 9,269,297 B2
(45) Date of Patent: Feb. 23, 2016

(54) ELECTRO-OPTICAL DEVICE

(71) Applicant: SAMSUNG DISPLAY CO., LTD., Yongin, Gyeonggi-Do (KR)

(72) Inventors: Eiji Kanda, Yokohama (JP); Takeshi Okuno, Yokohama (JP); Masayuki Kumeta, Yokohama (JP); Daisuke Kawae, Yokohama (JP); Ryo Ishii, Yokohama (JP); Naoaki Komiya, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/464,093

(22) Filed: Aug. 20, 2014

(65) Prior Publication Data

US 2015/0062193 A1 Mar. 5, 2015

(30) Foreign Application Priority Data

Aug. 29, 2013 (JP) ..... 2013-178371

(51) Int. Cl.
*G09G 5/10* (2006.01)
*G09G 3/32* (2006.01)

(52) U.S. Cl.
CPC ..... *G09G 3/3233* (2013.01); *G09G 3/3291* (2013.01); *G09G 2300/0809* (2013.01); *G09G 2310/027* (2013.01); *G09G 2320/0233* (2013.01); *G09G 2320/0626* (2013.01)

(58) Field of Classification Search
None
See application file for complete search history.

(56) References Cited

U.S. PATENT DOCUMENTS

2005/0269959 A1* 12/2005 Uchino ..... G09G 3/2011 315/169.3
2007/0040769 A1 2/2007 Tai et al.
2012/0306840 A1 12/2012 Han

FOREIGN PATENT DOCUMENTS

| | | | |
|---|---|---|---|
| EP | 2525348 | A2 | 11/2012 |
| EP | 2581899 | A2 | 4/2013 |
| JP | 2005-257878 | | 9/2005 |
| JP | 2006-309104 | | 11/2006 |
| JP | 2010-128491 | | 6/2010 |
| JP | 2011-002845 | | 1/2011 |
| JP | 2011-034038 | | 2/2011 |
| JP | 2012-208274 | | 10/2012 |
| WO | WO-2010/016316 | A1 | 11/2010 |

* cited by examiner

*Primary Examiner* — Nicholas Lee
(74) *Attorney, Agent, or Firm* — Lee & Morse, P.C.

(57) ABSTRACT

An electro-optical device includes a driving transistor, a first capacitor, a second capacitor, and a switching circuit. The driving transistor is connected between a power supply and an electrode of a light-emitting element. The first capacitor is connected between a gate and source of the driving transistor. The second capacitor stores a gray scale voltage. The switching circuit selectively connects the first capacitor and the second capacitor to the gate of the driving transistor. A control circuit applies the gray scale voltage to the second capacitor while the first capacitor is connected to the gate of the driving transistor by the switching circuit, and writes a source voltage of the driving transistor at the first capacitor while the second capacitor is connected to the gate of the driving transistor by the switching circuit.

20 Claims, 18 Drawing Sheets

Initializing <2>
[Source Reset]

ELECTRO-OPTICAL DEVICE

CROSS-REFERENCE TO RELATED APPLICATION

Japanese Patent Application No. 2013-178371, filed on Aug. 29, 2013, and entitled, "Electro-Optical Device," is incorporated by reference herein in its entirety.

BACKGROUND

1. Field

One or more embodiments described herein relate to an electro-optical device.

2. Description of the Related Art

An electro-optical device has been developed to include organic light-emitting diodes (OLEDs) that emit light according to the intensity of supplied current. In this device, driving transistorsreceives gate voltages corresponding to gray scale data of an image signal. These voltages determine the amount of current supplied to corresponding OLEDs. The luminance of the OLEDs is adjusted by controlling the intensity of current supplied to the OLEDs. The OLEDs may emit light of predetermined colors.

A field effect transistor (FET) is used as the driving transistor of each pixel. The FET has, as an inherent value, a gate voltage (threshold voltage Vth) at which current starts to flow between a source and drain. The current is proportional to a difference between the gate voltage and threshold voltage Vth (proportional to a square of this difference).

The threshold voltages of the driving transistors are irregular. Thus, even when the same gray scale voltage is applied to gates of the driving transistors, the amount of current supplied to respective OLEDs is often different from each other. Consequently, the luminance of light emitted from the OLEDs will differ from each other.

SUMMARY

In accordance with one embodiment, an electro-optical device includes a driving transistor connected between a power supply and an electrode of a light-emitting element; a first capacitor connected between a gate and a source of the driving transistor, the driving transistor to adjust current from the power supply based on a voltage stored in a first capacitor, the adjusted current to be supplied to the light-emitting element; a second capacitor to store a gray scale voltage; a switching circuit to selectively connect the first capacitor and the second capacitor to the gate of the driving transistor; and a control circuit to apply the gray scale voltage to the second capacitor while the first capacitor is connected to the gate of the driving transistor by the switching circuit, and to write a source voltage of the driving transistor at the first capacitor while the second capacitor is connected to the gate of the driving transistor by the switching circuit.

The switching circuit may include a first switching transistor connected between the second capacitor and the gate of the driving transistor; and a second switching transistor connected between the first capacitor and the gate of the driving transistor.

The device may include a third switching transistor connected between a data line and an electrode of the second capacitor, wherein the data line is to receive the gray scale voltage from the control circuit, and the third switching transistor is to apply the gray scale voltage to the second capacitor when turned on by the control circuit.

The device may include a fourth switching transistor connected between a signal line and an electrode of the first capacitor adjacent to the gate of the driving transistor, the signal line is to be supplied with a voltage lower than a voltage of the power supply, and the fourth switching transistor is to write the source voltage of the driving transistor at the first capacitor when turned on by the control circuit.

The device may include a fifth switching transistor connected between the driving transistor and the light-emitting element, wherein the fifth switching transistor is to connect the first capacitor to the gate of the driving transistor when turned on by the control circuit.

In accordance with another embodiment, a pixel circuit includes a driving transistor; a first capacitor to store a first voltage, a second capacitor to store a second voltage; wherein the first capacitor is selectively coupled to a gate of the driving transistor to store the first voltage when the second capacitor is not connected to the gate of the driving transistor, and wherein the second capacitor is selectively coupled to the gate of the driving transistor to store the second voltage when the first capacitor is not connected to the gate of the driving transistor. The first voltage may be based on a gate-source voltage of the driving transistor, and the second voltage may be based on a data voltage.

The second voltage may be transferred from the second capacitor to the first capacitor through a node connected to the gate of the driving transistor. The second voltage may be transferred to the first capacitor during a time when threshold voltage correction for the driving transistor is simultaneously performed.

The second capacitor may store a third voltage when the driving transistor is to control current to a light emitter based on the first voltage stored in the first capacitor. The second voltage may be a data voltage for a first frame, and the third voltage may be a data voltage for a second frame after the first frame.

The first capacitor may be connected between the gate and another terminal of the driving transistor. The first terminal of the first capacitor may be coupled to a source of the driving transistor, and a second terminal of the first capacitor is coupled to a node, the node may be coupled to the gate of the driving transistor, and the node may be coupled to receive an initialization voltage.

The initialization voltage may be received from a signal line carrying a data voltage and the initialization voltage, and the second voltage may be based on the data voltage. The first capacitor may be connected between the gate of the driving transistor and a signal line to supply a reference voltage. The driving transistor may be connected between a power supply line and a light emitter, and the first and second capacitors may be selectively connected to the gate of the driving transistor independent from the power supply line.

In accordance with another embodiment, an apparatus includes an interface and a controller to generate a first signal to selectively connect a first capacitor to a gate of a driving transistor when a second capacitor is not connected to the gate, and to generate a second signal to selectively connect the second capacitor to the gate of the driving transistor when the first capacitor is not connected to the gate, and wherein the interface is connected between the controller and a pixel circuit which includes the driving transistor and the first and second transistors.

The first capacitor may store a first voltage based on a gate-source voltage of the driving transistor, and the second capacitor may store a second voltage based on a data voltage. The first signal may control a first switch between the first capacitor and the gate of the driving transistor, and the second signal may control a second switch between the second capacitor and the gate of the driving transistor. The first control signal and the second control signal may have values to control transfer of a voltage from the second capacitor to the first capacitor during a time when threshold voltage correction for the driving transistor is to be simultaneously performed.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
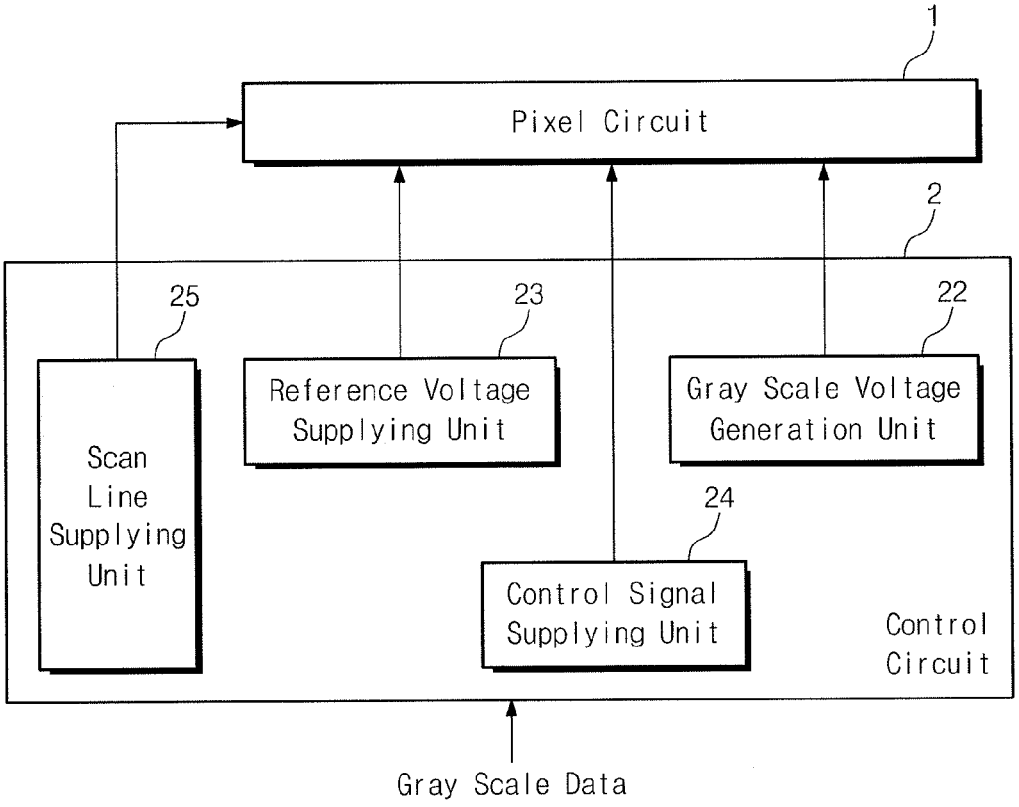
FIG. 1 illustrates an embodiment of an electro-optical device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element or layer is referred to as being "on", "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Figure 2:
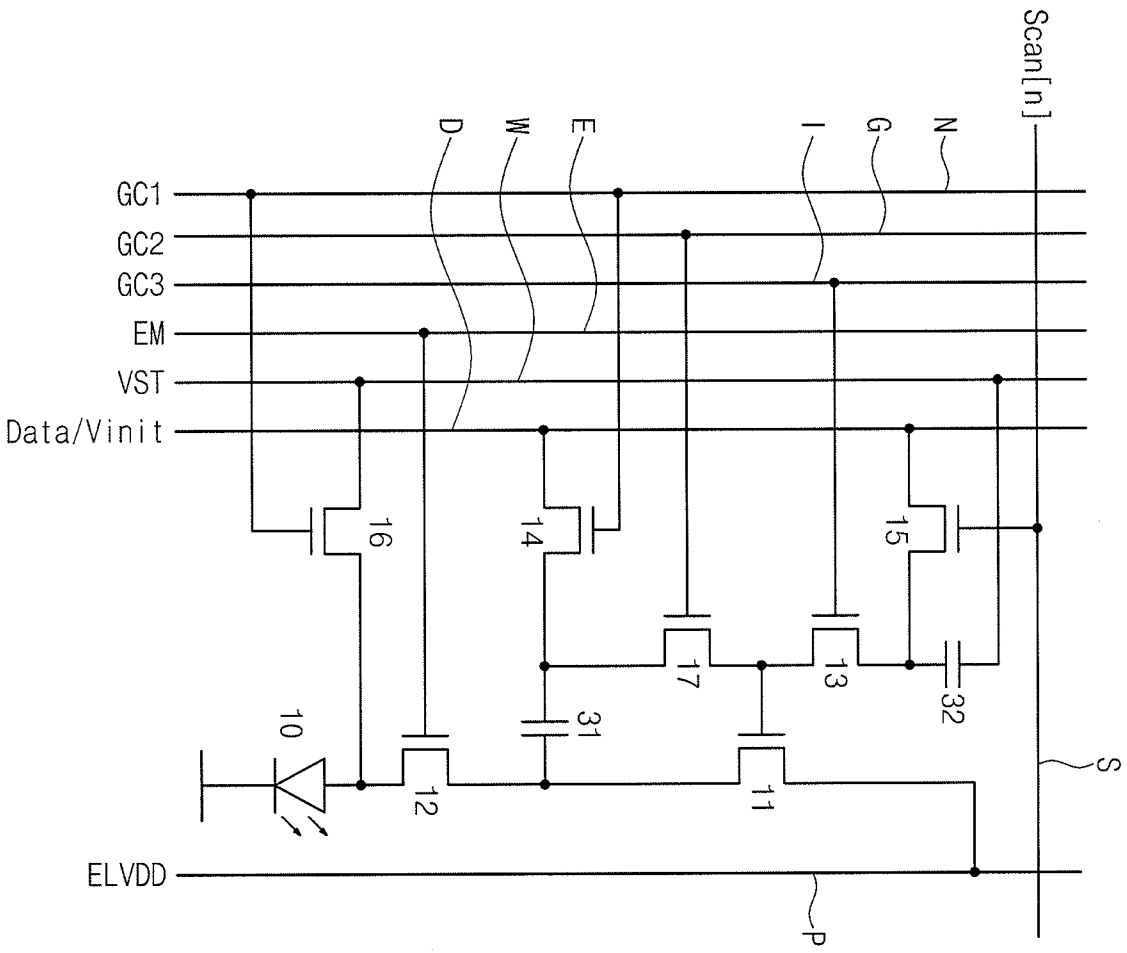
FIG. 2 illustrates an embodiment of a pixel circuit.

FIG. 1 illustrates a first embodiment of an electro-optical device, and FIG. 2 illustrates an embodiment of a pixel circuit 1 in the electro-optical device. As illustrated in FIG. 1, the electro-optical device includes the pixel circuit 1 and a control circuit 2.

The electro-optical device may include a display panel having a plurality of pixels. The pixels may bedivided into groups, each of which includes a predetermined number (e.g., three) of pixels. Each of the pixels in a group include an OLED 10 that emitsa different one of a plurality of colors (e.g., red, green, or blue) corresponding to gray scale values respectively set to express a full color to be emitted.

In FIG. 1, the pixel circuit 1 includes a set of OLEDs and driving circuits forthe pixels. The display panel includes the pixel circuit 1, where the OLEDs 10 and driving circuits are arranged in a matrix (e.g., pixel rows and pixel columns).

The driving circuits may bearranged side-by-side in a column direction. As illustrated in FIG. 2, the driving circuits are connected in common to a data line D, an initialization transistor driving line N, a bootstrap switch driving line G, a transfer switch driving line I, and a light-emitting switch driving line E. Each driving circuit is connected to a respective one of the OLEDs of a pixel. The driving circuits are also arranged side-by-side in a row direction. The driving circuits in each row are connected in common to a scan line S.

The driving circuits of all pixels may be connected to a first power line P and a second power line W. The first power line P delivers a constant voltage ELVDDsupplied from a power supply circuit. The constant voltage ELVDD may be sufficiently higher than a ground potential. The second power line W delivers a reference voltage VST which may be different from (e.g., sufficiently lower than) the voltage ELVDD.

The control circuit 2 receives an image signal including gray scale data of respective colors supplied from an external device. The control circuit 2 may be connected to the pixel circuit 1 through an interface. The interface may include one or more outputs of one or more chips implementing the control circuit, and/or one or more signal lines to be described below.

In one embodiment, the control circuit 2 supplies a gray scale voltage for setting the luminance of each OLED 10 or an initialization voltage Vinit to the data line D, and may simultaneously provide an initialization transistor driving signal GC1, a bootstrap switch driving signal GC2, a transfer switch driving signal GC3, and a light-emitting switch driving signal EM to the first initialization transistor driving line N, the bootstrap switch driving line G, the transfer switch driving line I, and the light-emitting switch driving line E, respectively. The control circuit 2 includes a gray scale data generation unit 22, a reference voltage supplying unit 23, a control signal supplying unit 24, and a scan signal supplying unit 25.

The reference voltage supplying circuit 23 supplies the reference voltage VST and the initialization voltage Vinit to the second power line W and the data line D, respectively. The gray scale voltage generation unit 22 generates gray scale voltages based on gray scale data corresponding to the colors and supplies the gray scale voltages Data to corresponding data lines D. Gray scale voltages to be set to respective pixels are sorted along pixel columns and are sequentially received by a unit of a pixel row.

The control signal supplying unit 24 supplies the initialization transistor driving signal GC1, the bootstrap switch driving signal GC2, the transfer switch driving signal GC3, and the light-emitting switch driving signal EM to the initialization transistor driving line N, the bootstrap switch driving line G, the transfer switch driving line I, and the light-emitting switch driving line E every predetermined vertical synchronization period, respectively. The scan signal supplying unit 25 provides a scan line S with a scan signal Scan for pointing out pixels that are supplied with gray scale voltages Vdata sequentially provided to the data lines D from the gray scale data generation unit 22.

In accordance with one embodiment, as illustrated in FIG. 2, each driving circuit includes a driving transistor 11 and a light-emitting switch transistor 12 connected in series between the first power line P and an anode of the OLED 10. A gate of the light-emitting switch transistor 12 is electrically connected to a light-emitting switch driving line E. A connection node between a source of the light-emitting switch transistor 12 and the anode of the OLED 10 is electrically connected to the second power line W via the second initialization transistor 16. A gate of a second initialization transistor 16 is electrically connected to the initialization transistor driving line N.

A connection node between a source of the driving transistor 11 and a drain of the light-emitting switch transistor 12 is connected to a data line D via a first capacitor 31 and a first initialization transistor 14. A gate of the first initialization transistor 14 is electrically connected to the initialization transistor driving line N.

A bootstrap switch transistor 17 is connected between a gate of the driving transistor 11 and a connection node between the first capacitor 31 and the first initialization transistor 14. A gate of the bootstrap switch transistor 17 is connected to a bootstrap switch driving line G.

The gate of the driving transistor 11 is also connected to the second power line W via a transfer switch transistor 13 and a second capacitor 32. A gate of the transfer switch transistor 13 is connected to the transfer switch driving line I. A connection node between the transfer switch transistor 13 and the second capacitor 32 is connected to the data line D via a scan transistor 15. A gate of the scan transistor 15 is connected to the scan line S. One of the first or second capacitors 31 and 32 is connected to the gate of the driving transistor 11, because the transfer switch transistor 13 and the bootstrap switch transistor 17 are selectively turned on, not simultaneously turned on. The transfer switch transistor 13 and the bootstrap switch transistor 17 may be considered to be a type of switching circuit.

Transistors 11 to 17 are N-channel MOSFETs. In another embodiment, one or more, or even all, of the transistors 11 to 17 may be P-channel MOSFETs.

Figure 3:
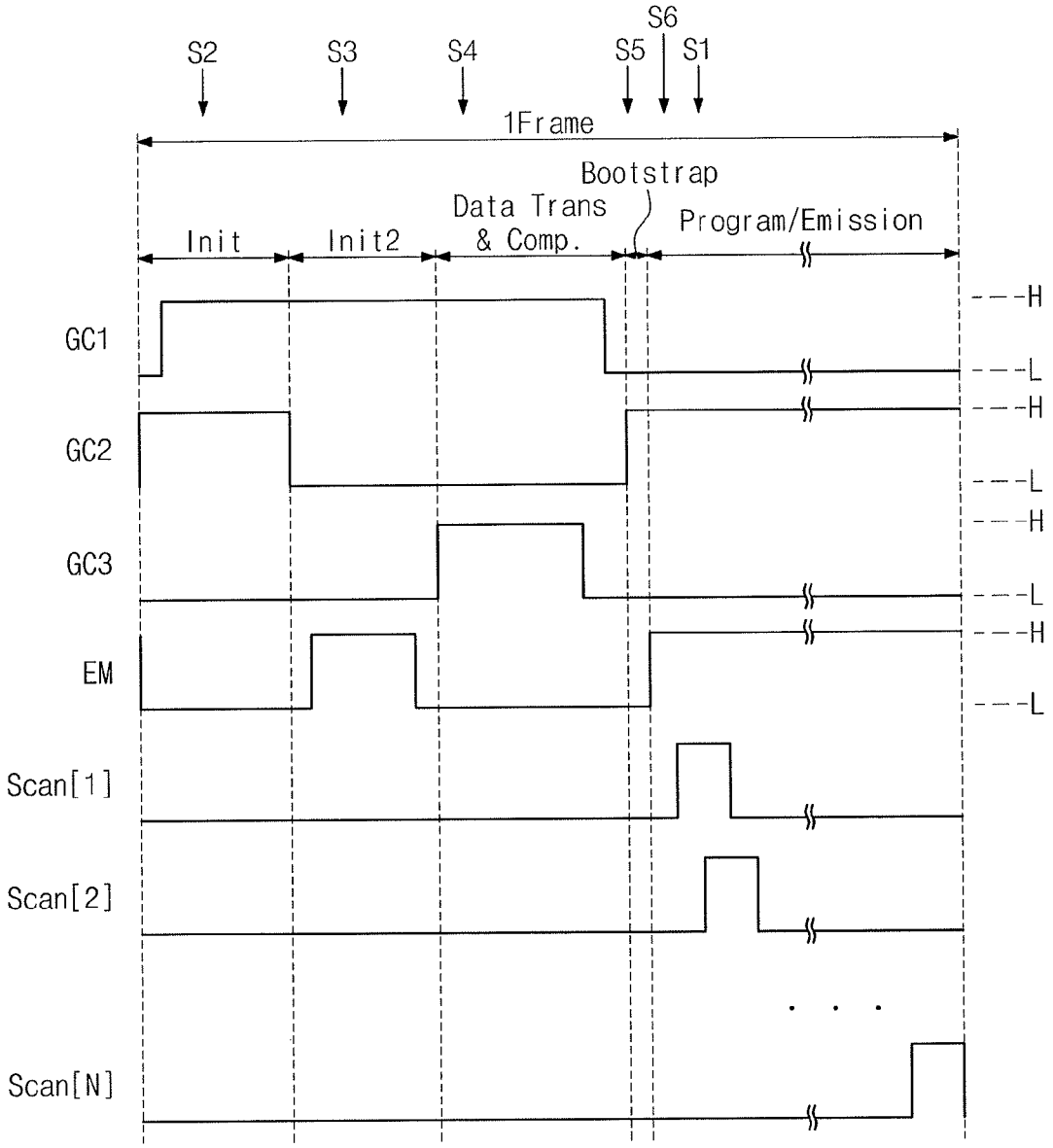
FIG. 3 illustrates an embodiment of signals for controlling the pixel circuit.

FIG. 3 is an example of a timing diagram for controlling the driving circuit and the OLED 10 of each pixel. FIGS. 4 to 9 illustrate different operations of the driving circuit based on this timing diagram.

The following procedure may be iterated whenever the gray scale voltage generation unit 22 generates a gray scale voltage of a frame unit by a period synchronized with a vertical synchronization signal. The control circuit 2 may control gray scale voltages on all columns to be output independently of one another, and may control gray scale signals to be sequentially output by the pixel at the driving circuit of the pixel.

Afterwards, the control circuit 2 may perform initialization on all pixel rows, Vth correction, and a transfer of data to the first capacitor 31. Next, the control circuit 2 may execute programming on gray scale data of a next frame, to make the OLED 10 emit light according to transmitted data. The timing diagram of FIG. 3 includes operations to be performed when programming on gray scale data of any frame is to be executed.

Figure 4:
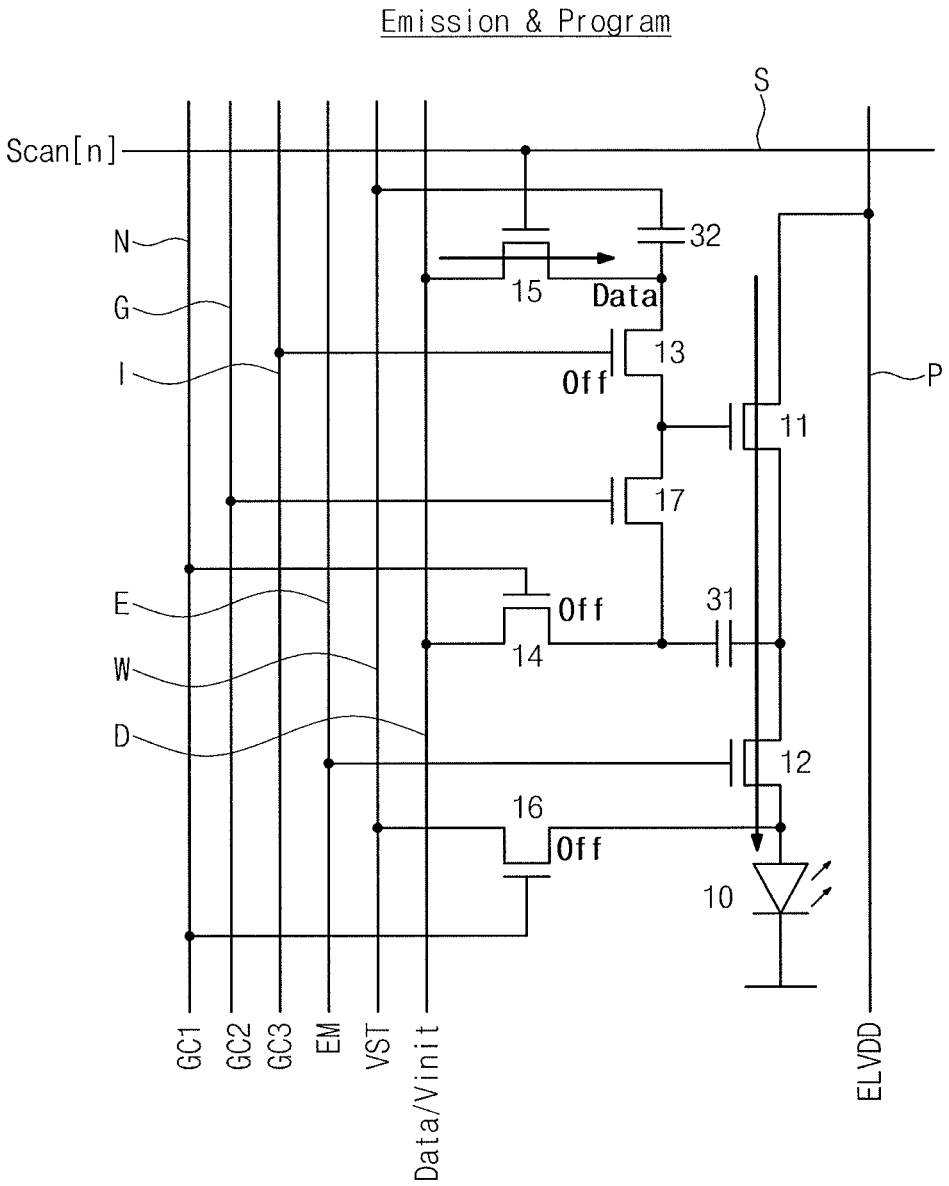
FIG. 4 illustrates operation of the driving circuit at state S1.
Figure 5:
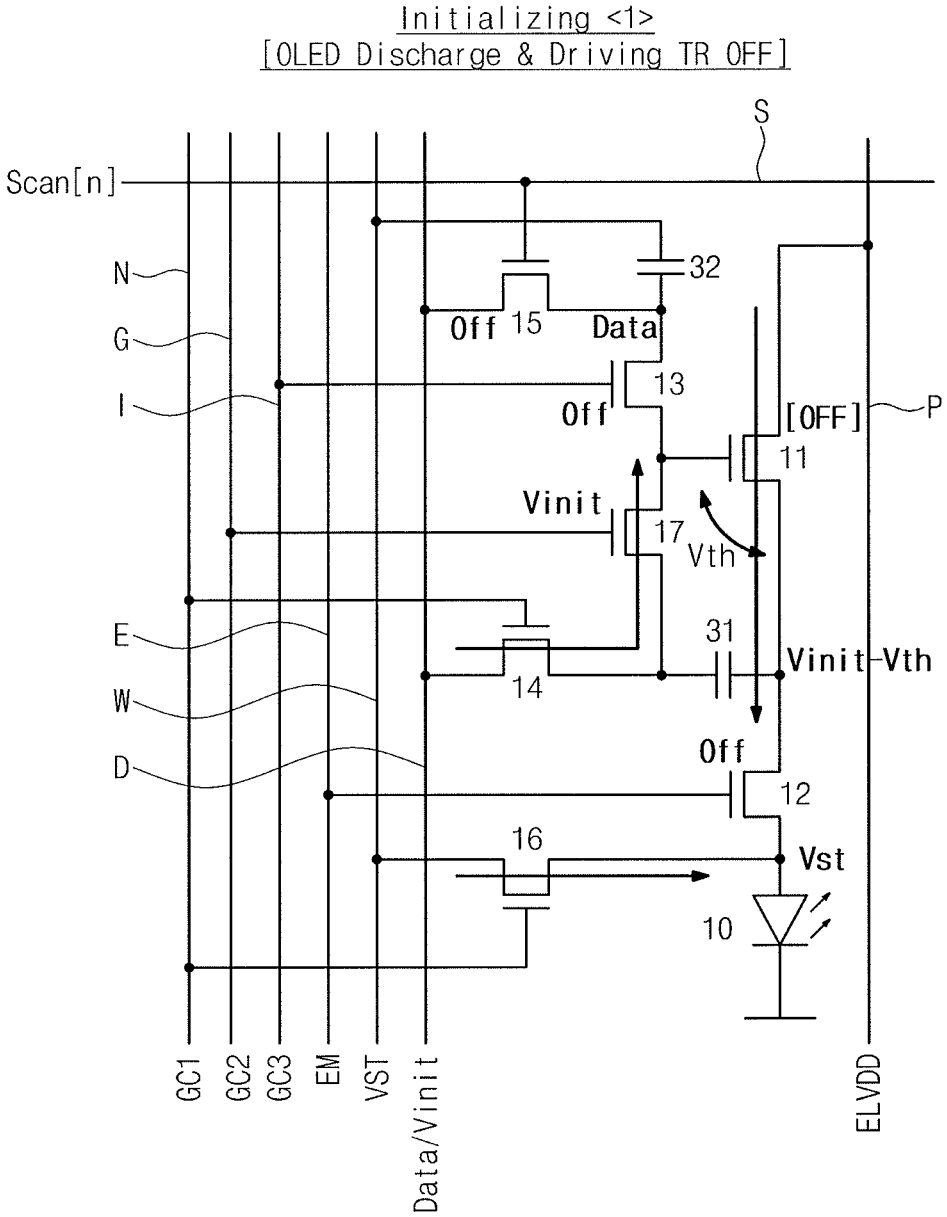
FIG. 5 illustrates operation of the driving circuit at state S2.

At time S1 in FIG. 3, the control circuit 2 sets a potential of a first initialization transistor driving signal GC1 to L (e.g., a first initialization transistor 14 is turned off and a second initialization transistor 16 is turned off), a potential of a bootstrap switch driving signal GC2 to H (e.g., a bootstrap switch transistor 17 is turned on), a potential of a transfer switch driving signal GC3 to L (e.g., a transfer switch transistor 13 is turned off), and a potential of a light-emitting switch driving signal EM to H (e.g., a light-emitting switch transistor 12 is turned on) with respect to all pixel rows (refer to FIG. 4). Here, L means low and H means high.

With this condition, the driving transistor 11 and the second capacitor 32 are electrically separated, the first capacitor 31 is floated, and the driving transistor 11 supplies current to the OLED 10 according to a voltage Vgs (=Vinit−Data+Vth) that the first capacitor 31 holds according to a gray scale voltage of a previous frame. As a result, the OLED 10 emits light having a luminance which corresponds to the gray scale voltage. Driving circuits of all pixels may operate substantially the same as the driving circuit shown in FIG. 4.

During this time, the control circuit 2 maintains a potential of the first scan signal Scan as L (e.g., a scan transistor 15 is turned off) with respect to the rest of pixel rows, except for a scan-target pixel row (e.g., a first pixel row at the beginning and switched to a next pixel row sequentially according to a horizontal synchronization signal). The control circuit 2 also switches a potential of the first scan signal Scan to H (e.g., the scan transistor 15 is turned on) with respect to the scan-target pixel row (refer to FIG. 4).

Also, at time S1, the control circuit 2 supplies a gray scale voltage Data of the scan-target pixel row to the data line D, so the gray scale voltage Data is stored in the second capacitor 32. Also, now that the transfer switch transistor 13 is turned off, the gray scale voltage Data does not influence a gate voltage of the driving transistor 11.

The control circuit 2 may perform the above-described programming with respect to all pixel rows by sequentially switching a scan-target pixel row whenever a predetermined horizontal synchronization signal is received. By switching a scan-target pixel row to a next pixel row, the control circuit 2 sets a potential of the first scan signal Scan of a pixel row where programming ends to L (e.g., the scan transistor 15 is turned off). At this time, the gray scale voltage Data is maintained in the first capacitor 31.

When programming on all pixel rows is completed, at time S2 in FIG. 3, the control circuit 2 may switch a voltage supplied to the data line D to the initialization voltage Vinit. Simultaneously, the control circuit may set a potential of the initialization transistor driving signal GC1 to H (e.g., the first initialization transistor 14 is turned on and the second initialization transistor 16 is turned on) and a potential of the light-emitting switch driving signal EM to L (e.g., the light-emitting switch transistor 12 is turned off) (refer to FIG. 5).

In this case, the OLED 10 does not emit light because current from ELVDD is blocked by the light-emitting switch transistor 12. Also, the anode of the OLED 10 is reset to the reference voltage VST, and charge accumulated by parasitic capacitance of the OLED 10 by light-emitting in a previous frame is discharged. As a result, abnormal light-emission caused by current flow into the OLED 10 may be prevented, even though a value of a gray scale voltage Data corresponds to a black value.

At the same time, a gate potential of the driving transistor 11 is reset to the initialization voltage Vinit. Also, a source potential of the driving transistor 11 floated has a value of (Vinit−Vth) (Vth being a threshold voltage of the driving transistor 11). That is, the driving transistor 11 is turned off. At this time, a voltage stored in parasitic capacitance between the gate and the source of the driving transistor 11 is Vth.

Figure 6:
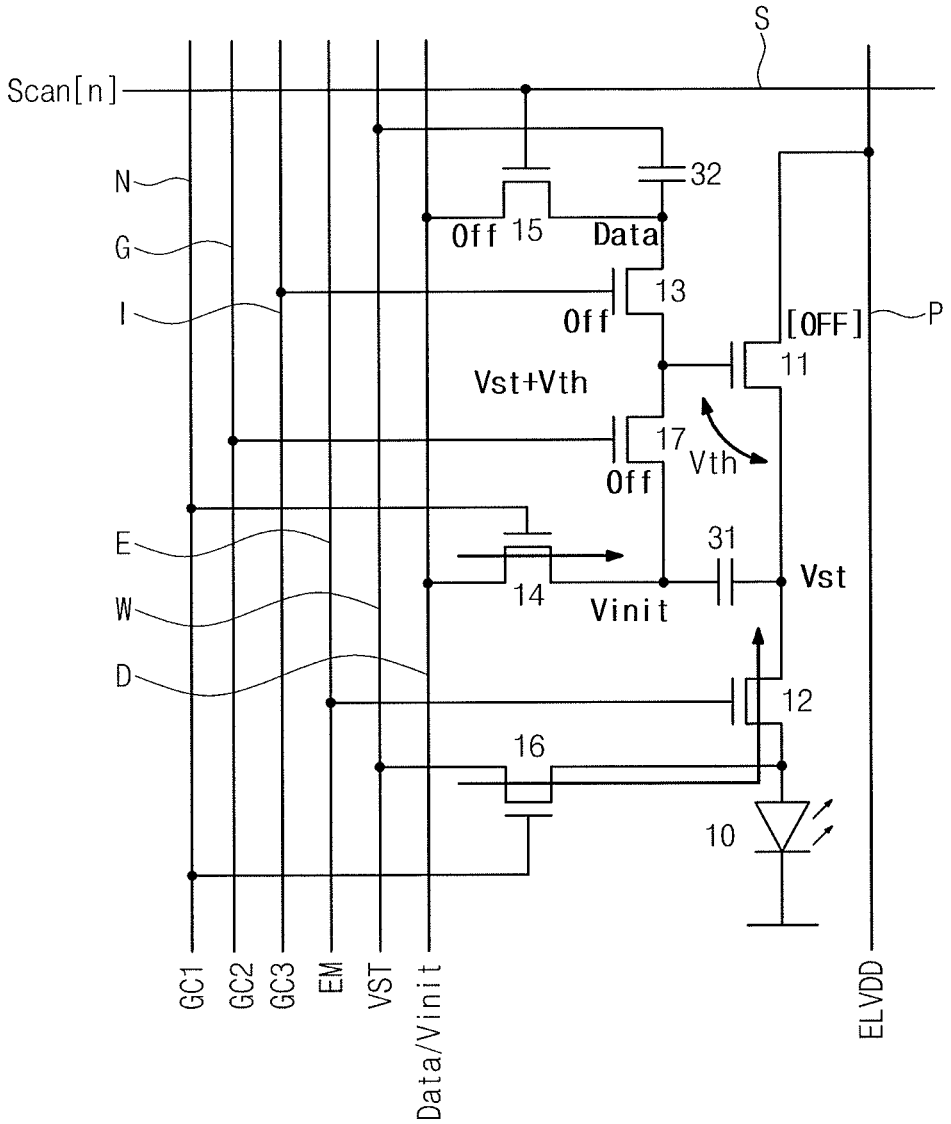
FIG. 6 illustrates operation of the driving circuit at state S3.

At time S3 in FIG. 3, the control circuit 2 switches a potential of the bootstrap switch driving signal GC2 to L (e.g., the bootstrap switch transistor 17 is turned off) and a potential of the light-emitting switch driving signal EM to H (e.g., the light-emitting switch transistor 12 is turned on) with respect to all pixel rows (refer to FIG. 6). With this bias condition, the first capacitor 31 is separated from the gate of the driving transistor 11 because the bootstrap switch transistor 17 is turned off.

Also, because the light-emitting switch transistor 12 is turned on, the source of the driving transistor 11 is reset to the reference voltage VST and a gate voltage of the driving transistor 11 is (VST+Vth) due to capacitive coupling of the parasitic capacitance between the gate and the source of the driving transistor 11. At this time, a short circuit between the first power line P and the second power line W is prevented because the driving transistor 11 is turned off.

Figure 7:
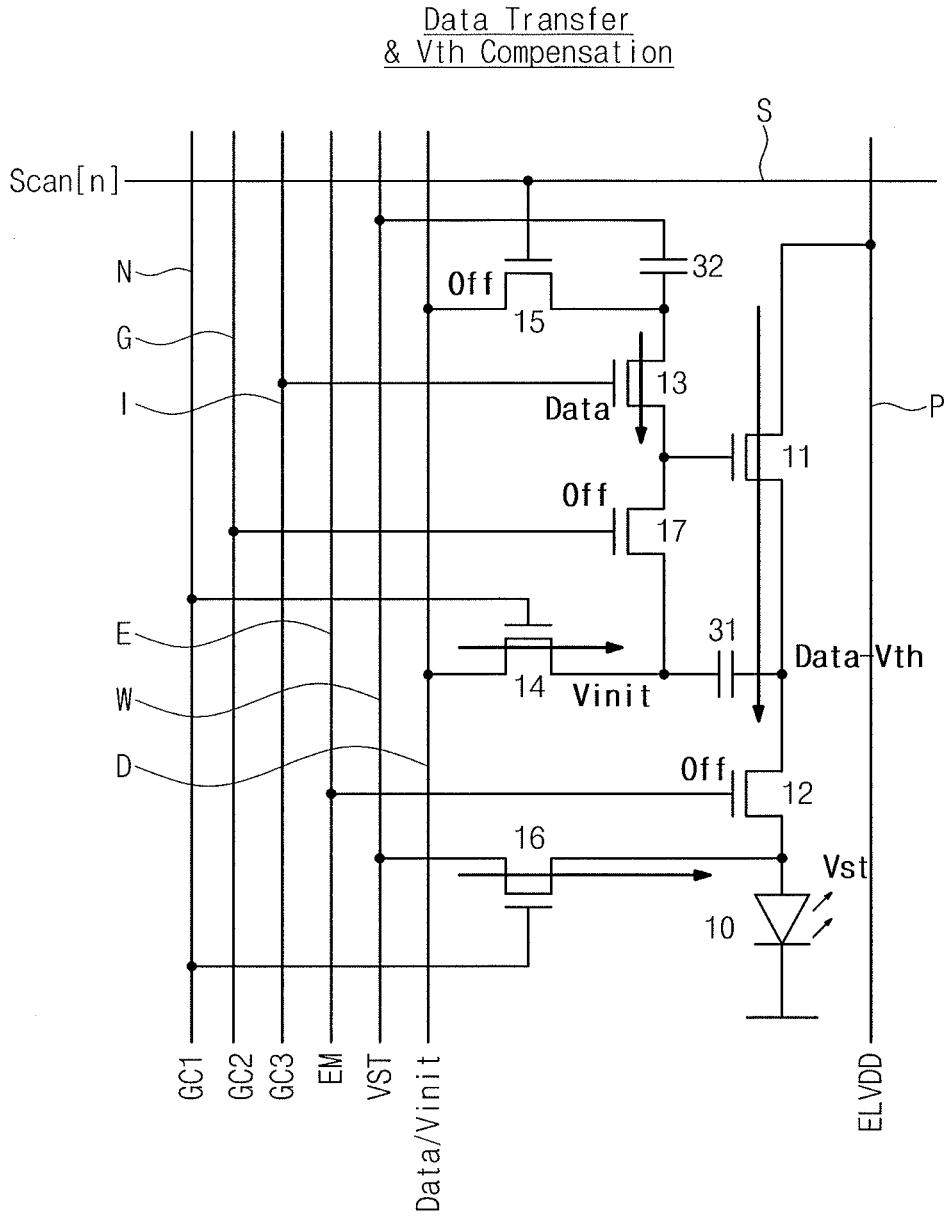
FIG. 7 illustrates operation of the driving circuit at state S4.

At time S4 in FIG. 3, the control circuit 2 sets a potential of the transfer switch driving signal GC3 to H (e.g., the transfer switch transistor 13 is turned on) and a potential of the light-emitting switch driving signal EM to L (e.g., the light-emitting switch transistor 12 is turned off) with respect to all pixel rows (refer to FIG. 7). In this case, in the driving circuits of all pixels, a gray scale voltage Data stored in the second capacitor 32 is applied to the gate of the driving transistor 11 via the transfer switch transistor 13. At this time, the driving transistor 11 is instantly turned on because a voltage Vth is stored in the parasitic capacitance between the gate and the source of the driving transistor 11 as described above.

In this case, the driving transistor 11 may operate as a source follower circuit, and current which flows from ELVDD through the driving transistor 11, the first capacitor 31, and the first initialization transistor 14, and a source voltage of the driving transistor 11 becomes (Data−Vth). At this time, a voltage (Vinit−Data+Vth) is maintained in the first capacitor 31. That is, with the above-described operation, transfer of the gray scale voltage Data from the second capacitor 32 to the first capacitor 31 and Vth correction on a corresponding gray scale voltage Data are simultaneously performed through the driving transistor 11.

Figure 8:
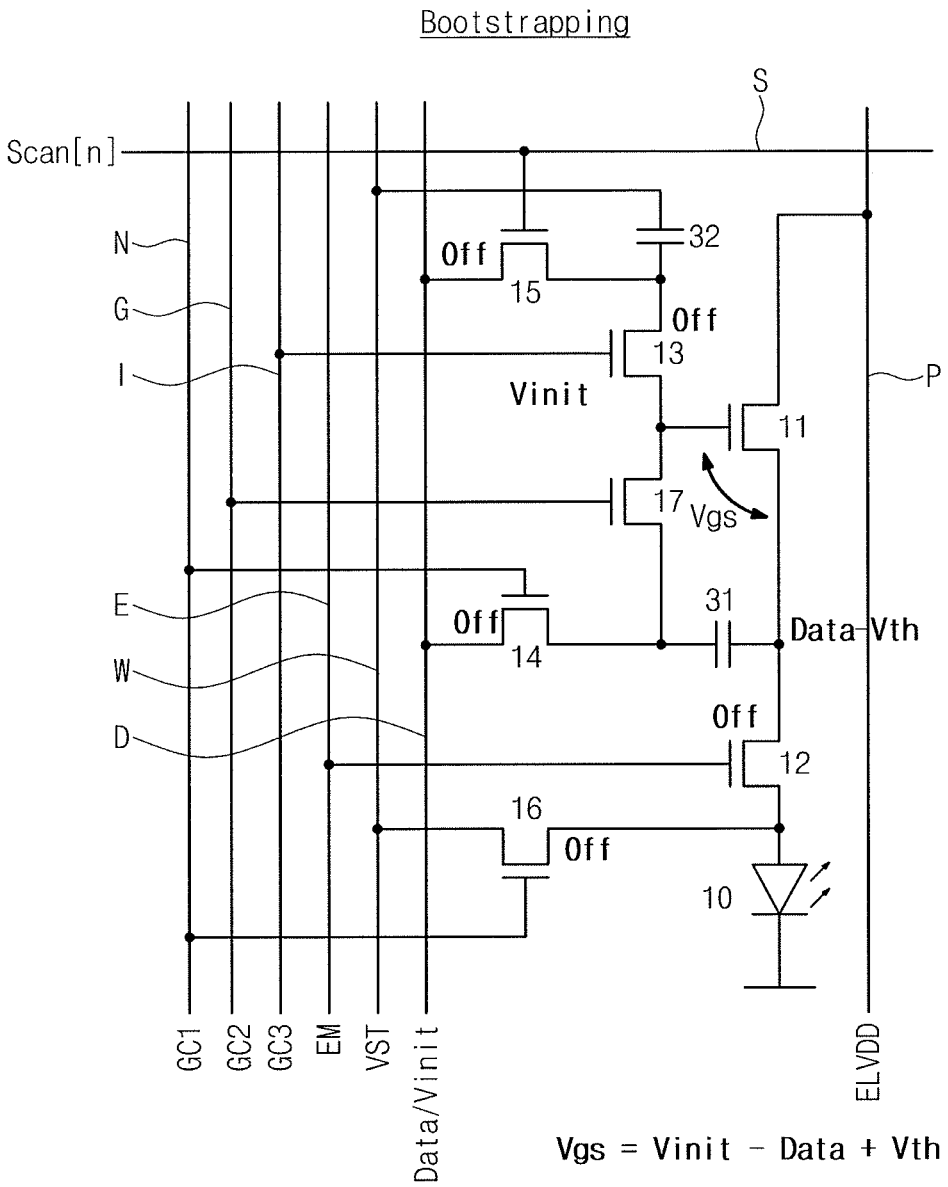
FIG. 8 illustrates operation of the driving circuit at state S5.

At time S5 in FIG. 3, the control circuit 2 sets a potential of the first initialization transistor driving signal GC1 to L (e.g., the first initialization transistor 14 is turned off and the second initialization transistor 16 is turned off), a potential of the power blocking signal GC2 to H (e.g., the bootstrap switch transistor 17 is turned on), and a potential of the transfer switch driving signal GC3 to L (e.g., the transfer switch transistor 13 is turned off) with respect to all pixel rows (refer to FIG. 8).

With this condition, in the driving circuits of all pixels, because the transfer switch transistor 13 is turned off, the second capacitor 32 is electrically separated from the gate of the driving transistor 11. Also, because the first initialization transistor 14 is turned off and the bootstrap switch transistor 17 is turned on, the driving transistor 11 is bootstrapped and a voltage (Vinit−Data+Vth) held in the first capacitor 31 is applied between the gate and the source of the driving transistor 11. In this case, charge sharing does not matter because parasitic capacitance between the gate and the source of the driving transistor 11 is greater than capacitance of the first capacitor 31, and a gate-source voltage Vgs of the driving transistor 11 is (Vinit−Data+Vth).

Figure 9:
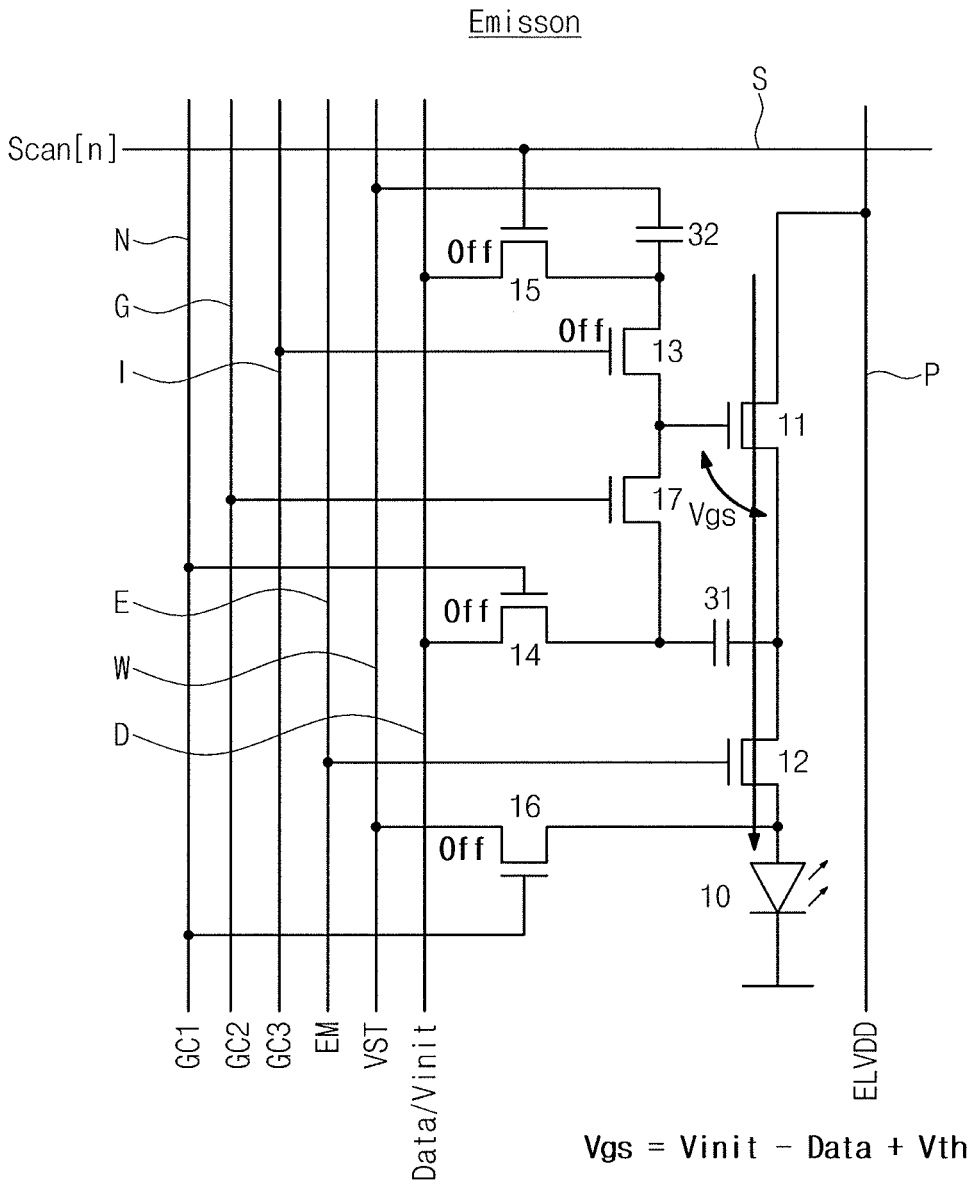
FIG. 9 illustrates operation of the driving circuit at state S6.

At time S6 in FIG. 3, the control circuit 2 switches a potential of the light-emitting switch driving signal EM to H (e.g., the light-emitting switch transistor 12 is turned on) with respect to all pixel rows (refer to FIG. 9). In this case, current proportional to a voltage (Vinit−Data) dropped by a threshold voltage Vth from the gate-source voltage Vgs (=Vinit−Data+Vth) flows through the driving transistor 11, to thereby cause the OLED 10 to emit light. This means that the luminance of the OLED 10 depends on a value of the gray scale voltage Data.

Afterwards, the control circuit 2 executes an operation following S1 to receive a next gray scale voltage to make the OLED 10 continue to emitting light.

As described above, a memory or storage element (e.g., the second capacitor 32) for data input is provided independently of a memory or storage element (the first capacitor 31) for holding Vgs of the driving transistor 11. Also, next gray scale data is provided to a data input memory as the driving transistor 11 supplies driving current to an OLED 10 based on Vgs held by the memory for holding Vgs. Thus, it is possible to provide sufficient time for programming and Vth correction.

Figure 10:
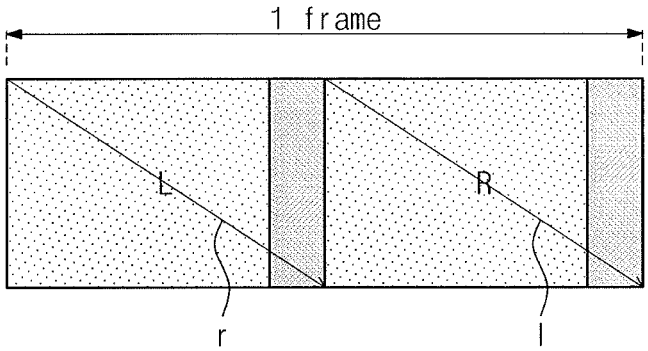
FIG. 10 illustrates an electro-optical device driven in a frame-sequential manner of three-dimensional display according to one embodiment.

Therefore, as illustrated in FIG. 10, even though a three-dimensional image is displayed in a frame-sequential manner, an image is displayed by emitting light from each OLED 10 during periods except for a transition period in which left and right shutters are simultaneously opened and closed. Simultaneously, programming may be executed in a period where an image of each frame is displayed and a period where left and right shutters are simultaneously closed.

In FIG. 10, the abscissa corresponds to elapsed time and the ordinate corresponds to a pixel row of a display. A portion marked by a dark color indicates a transition period during which left and right shutters are simultaneously opened and closed. The arrow I indicates a timing when Vth correction and data input begins with respect to the OLEDs of each pixel row to display a left-eye image. A period (L) marked by dots indicates a light-emitting period of each pixel row where a left-eye image is displayed. The arrow r indicates a timing when Vth correction and data input begins with respect to the OLEDs of each pixel row to display a right-eye image. The period R marked by dots indicates a light-emitting period of each pixel row where a right-eye image is displayed.

In the first embodiment, Vth correction is finely executed by making the program period longer, even though an image becomes brighter in external appearance by elongating light-emitting time.

Nevertheless, functioning as a source follower circuit, the driving transistor 11 transfers gray scale data provided to the memory (e.g., the second capacitor 32) to another memory (e.g., the first capacitor 31). At this time, the Vth correction is performed with respect to corresponding gray scale data. Therefore, gray scale data is transferred without a voltage drop, even though a voltage stored in each memory may vary.

Figure 11:
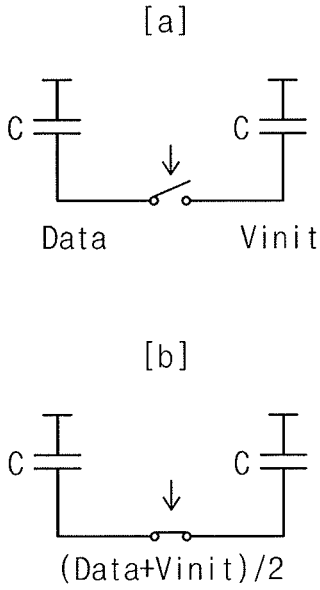
FIG. 11 illustrates a performance result according to at least one embodiment.

FIG. 11 illustrates examples where charge is transferred between capacitors. Because a data voltage decreases due to charge sharing, improved operation in accordance with at least one embodiment may be achieved.

Also, a new source follower circuit for data transmission does not need to be implemented because the driving transistor 11 performs both a data transmission function and a function of controlling the driving current. The structure of the driving circuit may therefore be simplified.

Also, because the driving transistor 11 corrects Vth by itself, the Vth correction is performed more exactly even though unevenness between adjacent transistors may be large. Also, simultaneous data transmission and the Vth correction may enable patterns of control signals to be simplified and influence due to switching noise to be reduced.

Modified Embodiment

Figure 12:
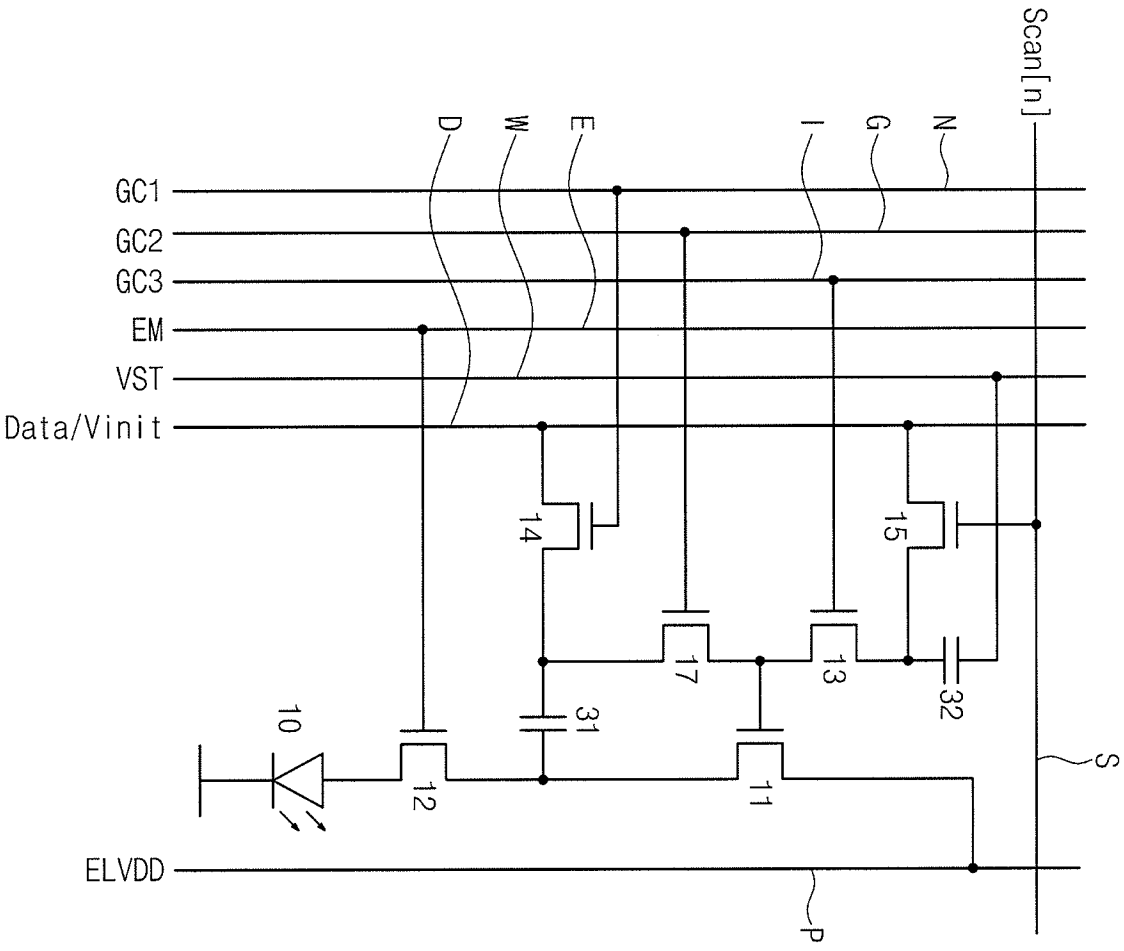
FIG. 12 illustrates a modification of a driving circuit in FIG. 1.

In the first embodiment, if parasitic capacitance of an OLED 10 or parasitic capacitance between the gate and the source of the driving transistor 11 is small enough to ignore, as illustrated in FIG. 12, the second initialization transistor 16 may be removed. Thus, the operations of discharging regulation capacitance of the OLED 10 and initializing the source of the driving transistor 11 may be skipped. In this case, the second capacitor 32 is connected to the first power line P, so that a difference between ELVDD and a gray scale voltage Data is stored in the second capacitor 32. As a result, the second power line W may be removed.

Figure 13:
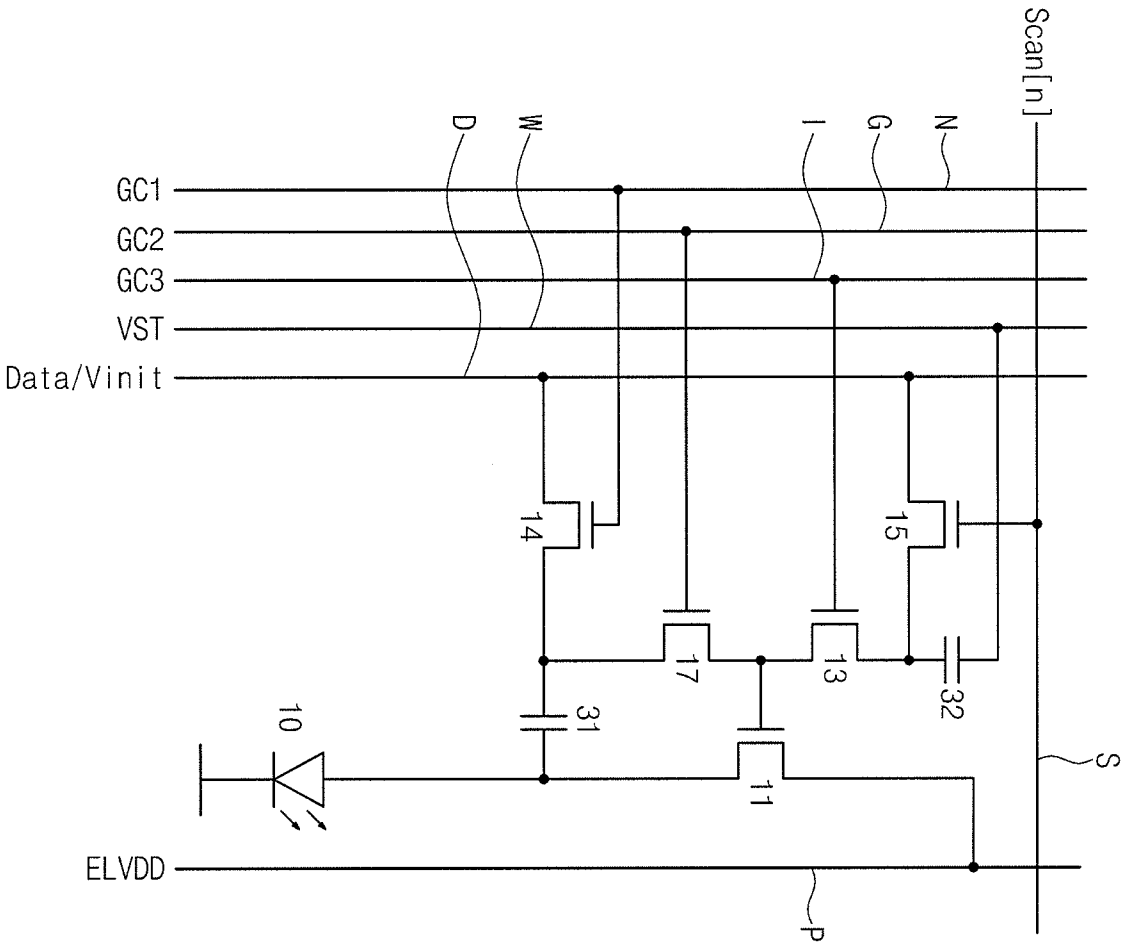
FIG. 13 illustrates another embodiment of a pixel circuit.
Figure 14:
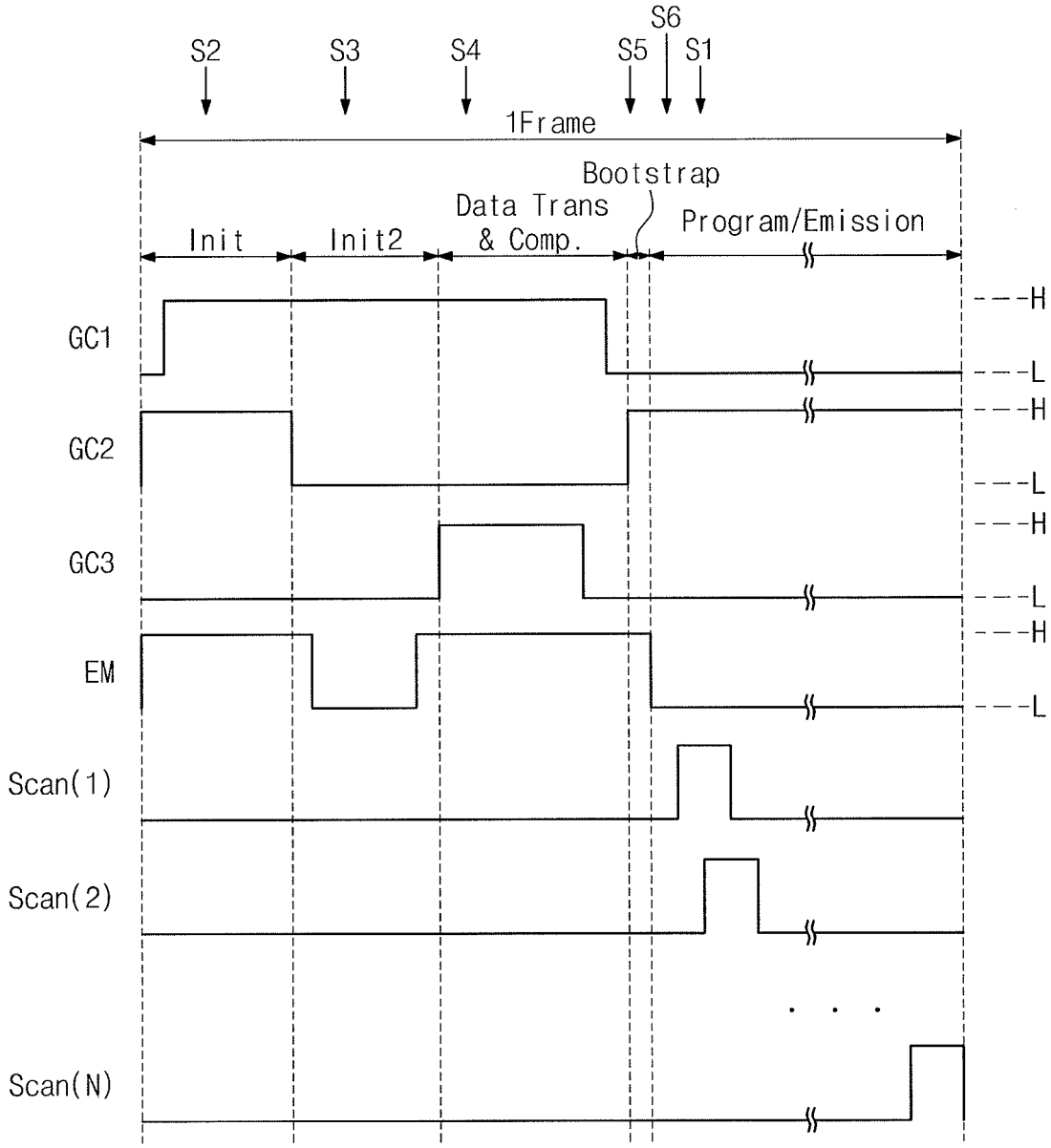
FIG. 14 illustrates an example of control signals for the pixel circuit of FIG. 13.

FIG. 13 illustrates another embodiment of an electro-optical device, and FIG. 14 is a timing diagram illustrating control signals for the device in FIG. 13.

The electro-optical device includes a plurality of pixels, each of which has a pixel circuit as illustrated in FIG. 13. The pixel circuit of FIG. 13 does not include the light-emitting switch driving line E, the light-emitting switch transistor 12, and the second initialization transistor 16 as in the embodiment of FIG. 2. Instead, the control circuit 2 provides a cathode voltage ELVSS to the OLED 10 to control on/off of current flowing to the OLED 10. Otherwise, the pixel circuit shown in FIG. 13 may be substantially the same as the pixel circuit of FIG. 2.

Referring to FIG. 14, the control circuit 2 controls the driving circuit of FIG. 13 based on a procedure which is iterated whenever a gray scale voltage generation unit 22 generates a gray scale voltage of a frame unit by a period synchronized with a vertical synchronization signal.

At time S1 in FIG. 14, the control circuit 2 sets the potential of a initialization transistor driving signal GC1 to L (e.g., a first initialization transistor 14 is turned off), a potential of a bootstrap switch driving signal GC2 to H (e.g., a bootstrap switch transistor 17 is turned on), a potential of a transfer switch driving signal GC3 to L (e.g., a transfer switch transistor 13 is turned off), and ELVSS to a ground potential with respect to pixels of a predetermined number (e.g., all) pixel rows.

With this condition, in the driving circuits of all pixels, a driving transistor 11 and a second capacitor 32 are electrically separated, a first capacitor 31 is floated, and the driving transistor 11 supplies current to the OLED 10 according to a voltage Vgs (=Vinit−Data+Vth) that the first capacitor 31 holds according to a gray scale voltage of a previous frame. As a result, the OLED 10 emits light having a luminance that corresponds to the gray scale voltage.

At the same time, the control circuit 2 maintains the potential of the first scan signal Scan at L (e.g., a scan transistor 15 is turned off) with respect to the rest of pixel rows except for a scan-target pixel row (e.g., a first pixel row at the beginning and switched into a next pixel row sequentially according to a horizontal synchronization signal). Also, the control circuit 2 switches a potential of the first scan signal Scan to H (e.g., the scan transistor 15 is turned on) with respect to the scan-target pixel row. At this point in time, the control circuit 2 supplies a gray scale voltage Data of the scan-target pixel row to the data line D, so the gray scale voltage Data is stored in the second capacitor 32. Also, as described above, now that the transfer switch transistor 13 is turned off, the gray scale voltage Data does not influence a gate voltage of the driving transistor 11.

The control circuit 2 performs the above-described programming with respect to all pixel rows by sequentially switching a scan-target pixel row whenever a predetermined horizontal synchronization signal is received. Switching a scan-target pixel row into a next pixel row, the control circuit 2 sets a potential of the first scan signal Scan of a pixel row where programming ends to L (e.g., the scan transistor 15 is turned off). At this time, the gray scale voltage Data is maintained in first capacitor 31.

When programming on all pixel rows is completed, at time S2 in FIG. 14, the control circuit 2 may switch a voltage supplied to the data line D into the initialization voltage Vinit. Simultaneously, the control circuit 2 may set the potential of the scan signal to L (e.g., the scan transistor 15 is turned off) with respect to all pixel rows, a potential of the initialization transistor driving signal GC1 to H (e.g., the first initialization transistor 14 is turned on), and ELVDD to the same potential as ELVDD.

In this case, the OLED 10 does not emit light because the current from ELVDD is blocked. Also, the charge accumulated in parasitic capacitance of the OLED 10 is discharged during light-emitting of a previous frame. Thus, abnormal light-emitting caused when current flows into the OLED 10 is prevented, even though a value of a gray scale voltage Data corresponds to a black value.

At the same time, the gate potential of the driving transistor 11 is reset to the initialization voltage Vinit. Also, the source potential of the driving transistor 11 floated has a value of (Vinit−Vth) (e.g., Vth being a threshold voltage of the driving transistor 11). That is, the driving transistor 11 is turned off. At this time, the voltage stored in parasitic capacitance between the gate and the source of the driving transistor 11 is Vth.

At time S3 in FIG. 14, the control circuit 2 switches a potential of the bootstrap switch driving signal GC2 to L (e.g., the bootstrap switch transistor 17 is turned off) and ELVDD to a ground potential with respect to all pixel rows. With this bias condition, the first capacitor 31 is separated from the gate of the driving transistor 11 because the bootstrap switch transistor 17 is turned off. Also, a short circuit between the first power line P and the second power line W is prevented because the driving transistor 11 is turned off.

At time S4 in FIG. 14, the control circuit 2 sets the potential of the transfer switch driving signal GC3 to H (e.g., the transfer switch transistor 13 is turned on) and ELVSS to the same potential as ELVDD. In this case, in the driving circuits of all pixels, a gray scale voltage Data stored in the second capacitor 32 is applied to the gate of the driving transistor 11 via the transfer switch transistor 13. At this time, the driving transistor 11 is instantly turned on, because a voltage Vth is stored in the parasitic capacitance between the gate and the source of the driving transistor 11 as described above.

In this case, the driving transistor 11 operates as a source follower circuit, current flows from ELVDD through the driving transistor 11, the first capacitor 31, and the first initialization transistor 14, and a source voltage of the driving transistor 11 becomes (Data−Vth). At this time, a voltage (Vinit−Data+Vth) is held in the first capacitor 31. That is, with the above-described operation, transfer of the gray scale voltage Data from the second capacitor 32 to the first capacitor 31 and Vth correction on a corresponding gray scale voltage Data are simultaneously performed through the driving transistor 11.

At time S5 in FIG. 14, the control circuit 2 sets the potential of the first initialization transistor driving signal GC1 to L (e.g., the first initialization transistor 14 is turned off), the potential of the power blocking signal GC2 to H (e.g., the bootstrap switch transistor 17 is turned on), and the potential of the transfer switch driving signal GC3 to L (e.g., the transfer switch transistor 13 is turned off) with respect to all pixel rows (refer to FIG. 7).

With this condition, in the driving circuits of all pixels, because the transfer switch transistor 13 is turned off, the second capacitor 32 is electrically separated from the gate of the driving transistor 11. Also, because the first initialization transistor 14 is turned off and the bootstrap switch transistor 17 is turned on, the driving transistor 11 is bootstrapped and a voltage (Vinit−Data+Vth) held in the first capacitor 31 is applied between the gate and the source of the driving transistor 11. Charge sharing does not matter because parasitic capacitance between the gate and the source of the driving transistor 11 is greater than capacitance of the first capacitor 31, and a gate-source voltage Vgs of the driving transistor 11 is (Vinit−Data+Vth).

At time S6 in FIG. 14, the control circuit 2 switches ELVSS to a ground potential with respect to all pixel rows. In this case, current proportional to a voltage (Vinit−Data) dropped by a threshold voltage Vth from the gate-source voltage Vgs (=Vinit−Data+Vth) flows through the driving transistor 11 to control the OLED 10 to emit light. This means that the luminance of the OLED 10 depends on the value of the gray scale voltage Data.

Afterwards, the control circuit 2 executes a process following S1 to receive a next gray scale voltage to control the OLED 10 to continue to emit light. The remaining operations may be substantially the previous embodiment.

Figure 15:
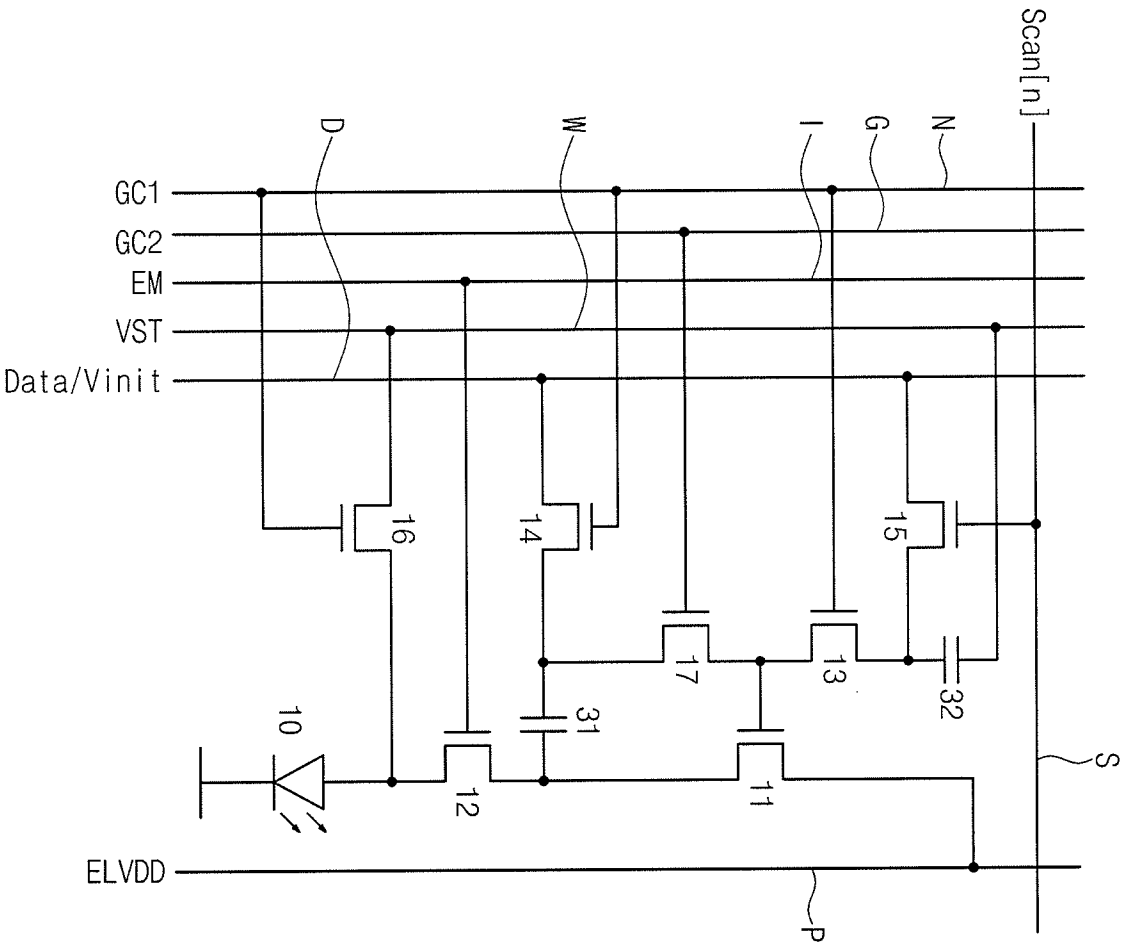
FIG. 15 illustrates another embodiment of a pixel circuit.
Figure 16:
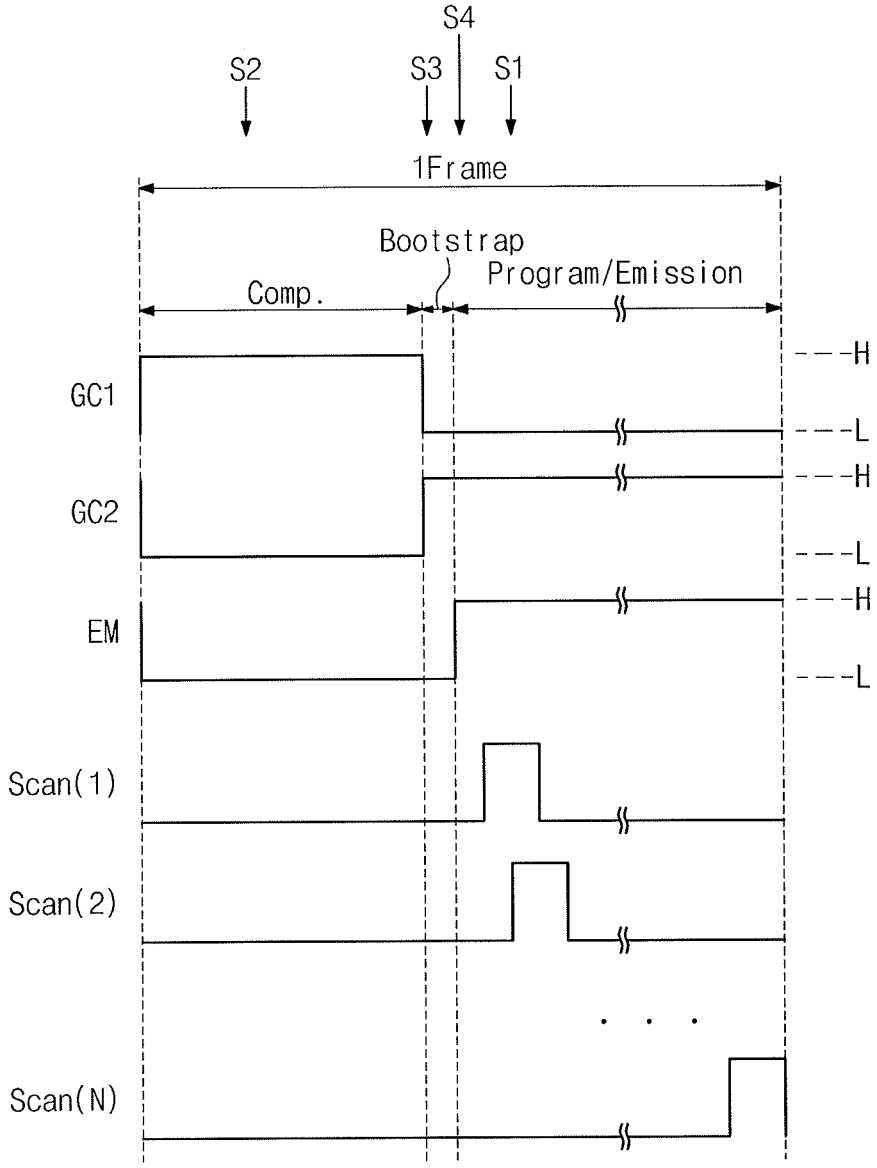
FIG. 16 illustrates an example of control signals for the pixel circuit of FIG. 15.

FIG. 15 illustrates another embodiment of a pixel circuit included in a electro-optical device, and FIG. 16 is an example of a timing diagram including control signals for the pixel circuit in FIG. 15.

As illustrated in FIG. 15, the transfer switch driving line I is not connected to the transfer switch transistor 13. Instead, the gate of a transfer switch transistor 13 is connected to an initialization transistor driving line N. Additionally, unlike the electro-optical device in FIG. 2, the electro-optical device in FIG. 15 simultaneously performs initialization on the driving transistor 11 and the OLED 10 and transfers gray scale data. Otherwise, the electro-optical device in FIG. 15 may be substantially the same as in FIG. 2.

The control circuit 2 controls the driving circuit of an OLED using the timing diagram in FIG. 16. The following procedure may be iterated whenever the gray scale voltage generation unit 22 generates a gray scale voltage of a frame unit by a period synchronized with a vertical synchronization signal.

At time S1 in FIG. 16, the control circuit 2 sets a potential of a initialization transistor driving signal GC1 to L (e.g., a transfer switch transistor 13 is turned off and first and second initialization transistors 14 and 16 are turned off), a potential of a bootstrap switch driving signal GC2 to H (e.g., a bootstrap switch transistor 17 is turned on), and a potential of a lie switch driving signal EM to H (e.g., a light-emitting switch transistor 12 is turned on) with respect to pixels of a predetermined number (e.g., all) pixel rows.

With this condition, the driving transistor 11 and the second capacitor 32 are electrically separated, a first capacitor 31 is floated, and the driving transistor 11 supplies current to the OLED 10 according to a voltage Vgs (=Vinit−Data+Vth) that the first capacitor 31 holds according to a gray scale voltage of a previous frame. As a result, the OLED 10 emits light with a luminance that corresponds to the gray scale voltage.

At the same time, the control circuit 2 maintains the potential of the first scan signal Scan to L (e.g., a scan transistor 15 is turned off) with respect to the rest of pixel rows, except for a scan-target pixel row (e.g., a first pixel row at the beginning and switched to a next pixel row sequentially according to a horizontal synchronization signal). Also, the control circuit 2 switches the potential of the first scan signal Scan to H (e.g., the scan transistor 15 is turned on) with respect to the scan-target pixel row. At this time, the control circuit 2 supplies a gray scale voltage Data of the scan-target pixel row to the data line D, so the gray scale voltage Data is stored in the second capacitor 32. Also, as above-described, because the transfer switch transistor 13 is turned off, the gray scale voltage Data does not influence a gate voltage of the driving transistor 11.

The control circuit 2 performs the above-described programming for all pixel rows by sequentially switching a scan-target pixel row whenever a predetermined horizontal synchronization signal is received. Switching a scan-target pixel row to a next pixel row, the control circuit 2 sets the potential of the first scan signal Scan of a pixel row where programming ends to L (e.g., the scan transistor 15 is turned off). At this time, the gray scale voltage Data is kept in the first capacitor 31.

When programming on all pixel rows is completed, at time S2 in FIG. 16, the control circuit 2 may switch a voltage supplied to the data line D to the initialization voltage Vinit. Simultaneously, the control circuit sets the potential of the scan signal to L (e.g., the scan transistor 15 is turned off) with respect to all pixel rows, a potential of the initialization transistor driving signal GC1 to H (e.g., the transfer switch transistor 13 is turned on and the first and second initialization transistors 14 and 16 are turned on), and a potential of the light-emitting switch driving signal EM to L (e.g., the light-emitting switch transistor 12 is turned off).

In this case, the OLED 10 is turned off because the current from ELVDD is blocked by the light-emitting switch transistor 12. Also, the anode of the OLED 10 is reset to a reference voltage VST, and charge accumulated in the parasitic capacitance of the OLED 10 during light-emitting of a previous frame is discharged. Thus, abnormal light-emission caused when current flows to the OLED 10 is prevented, even when a value of a gray scale voltage Data corresponds to a black value.

In the driving circuits of all pixels, the gray scale voltage Data stored in the second capacitor 32 is applied to the gate of the driving transistor 11 via the transfer switch transistor 13. Thus, the driving transistor 11 operates as a source follower circuit, current flows from ELVDD through the driving transistor 11, the first capacitor 31, and the first initialization transistor 14, and a source voltage of the driving transistor 11 becomes (Data−Vth). At this time, a voltage (Vinit−Data+Vth) is held in the first capacitor 31. That is, with the above-described operation, transfer of the gray scale voltage Data from the second capacitor 32 to the first capacitor 31 and Vth correction on a corresponding gray scale voltage Data are simultaneously perform through the driving transistor 11.

At time S3 in FIG. 16, the control circuit 2 sets the potential of the first initialization transistor driving signal GC1 to L (e.g., the transfer switch transistor 13 is turned off and the first and second initialization transistors 14 and 16 are turned off) and the potential of the power blocking signal GC2 to H (e.g., the bootstrap switch transistor 17 is turned on) with respect to all pixel rows.

With this condition, in the driving circuits of all pixels, because the transfer switch transistor 13 is turned off, the second capacitor 32 is electrically separated from the gate of the driving transistor 11. Also, because the first initialization transistor 14 is turned off and the bootstrap switch transistor 17 is turned on, the driving transistor 11 is bootstrapped and a voltage (Vinit−Data+Vth) held in the first capacitor 31 is applied between the gate and the source of the driving transistor 11. Charge sharing does not matter because parasitic capacitance between the gate and the source of the driving transistor 11 is greater than capacitance of the first capacitor 31, and a gate-source voltage Vgs of the driving transistor 11 is (Vinit−Data+Vth).

At time S4 in FIG. 16, the control circuit 2 switches the potential of the light-emitting switch driving signal EM to H (e.g., the light-emitting switch transistor 12 is turned on) with respect to all pixel rows. In this case, current proportional to a voltage (Vinit−Data) dropped by a threshold voltage Vth from the gate-source voltage Vgs (=Vinit−Data+Vth) flows through the driving transistor 11 to control the OLED 10 to emit light. The luminance of the OLED 10 therefore depends on a value of the gray scale voltage Data.

Afterwards, the control circuit 2 executes a process following S1 to receive a next gray scale voltage to control the OLED 10 to continue to emit light. The remaining operations and effects may be substantially the same as in the first embodiment.

Figure 17:
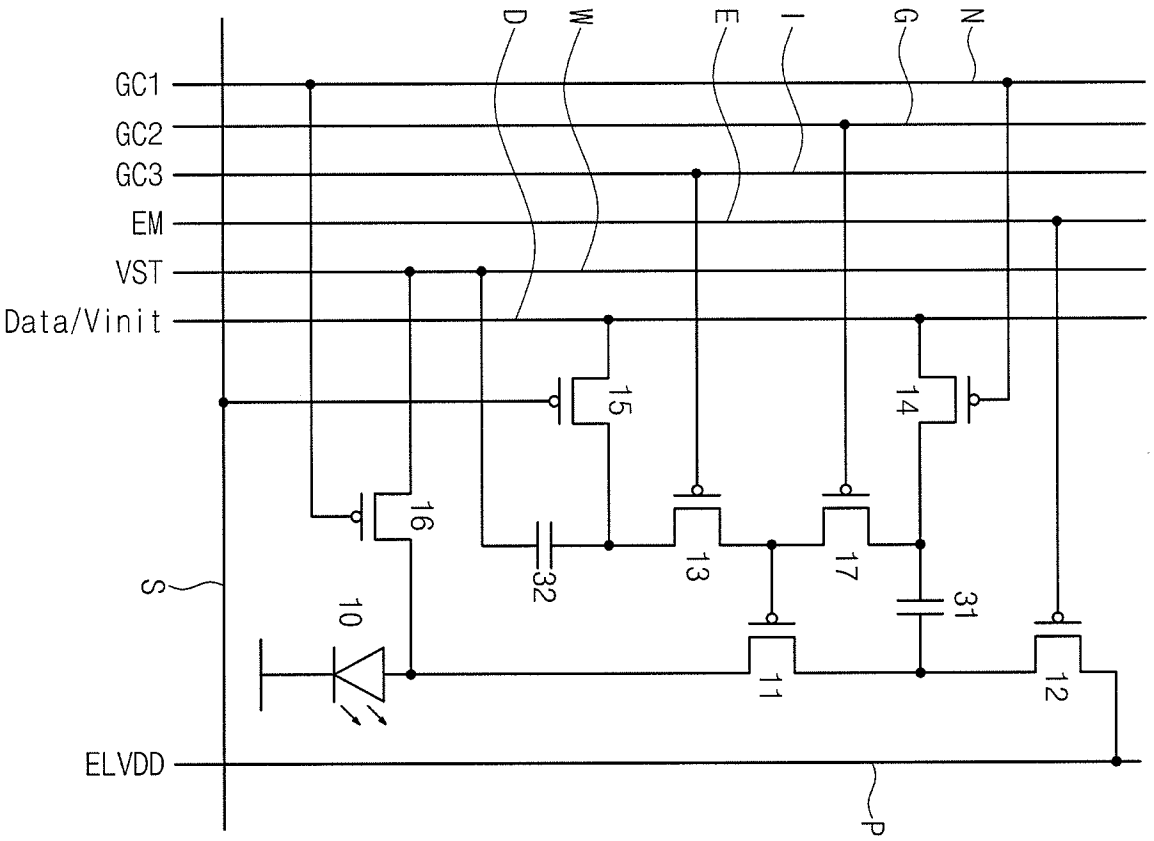
FIG. 17 illustrates another embodiment of a pixel circuit.
Figure 18:
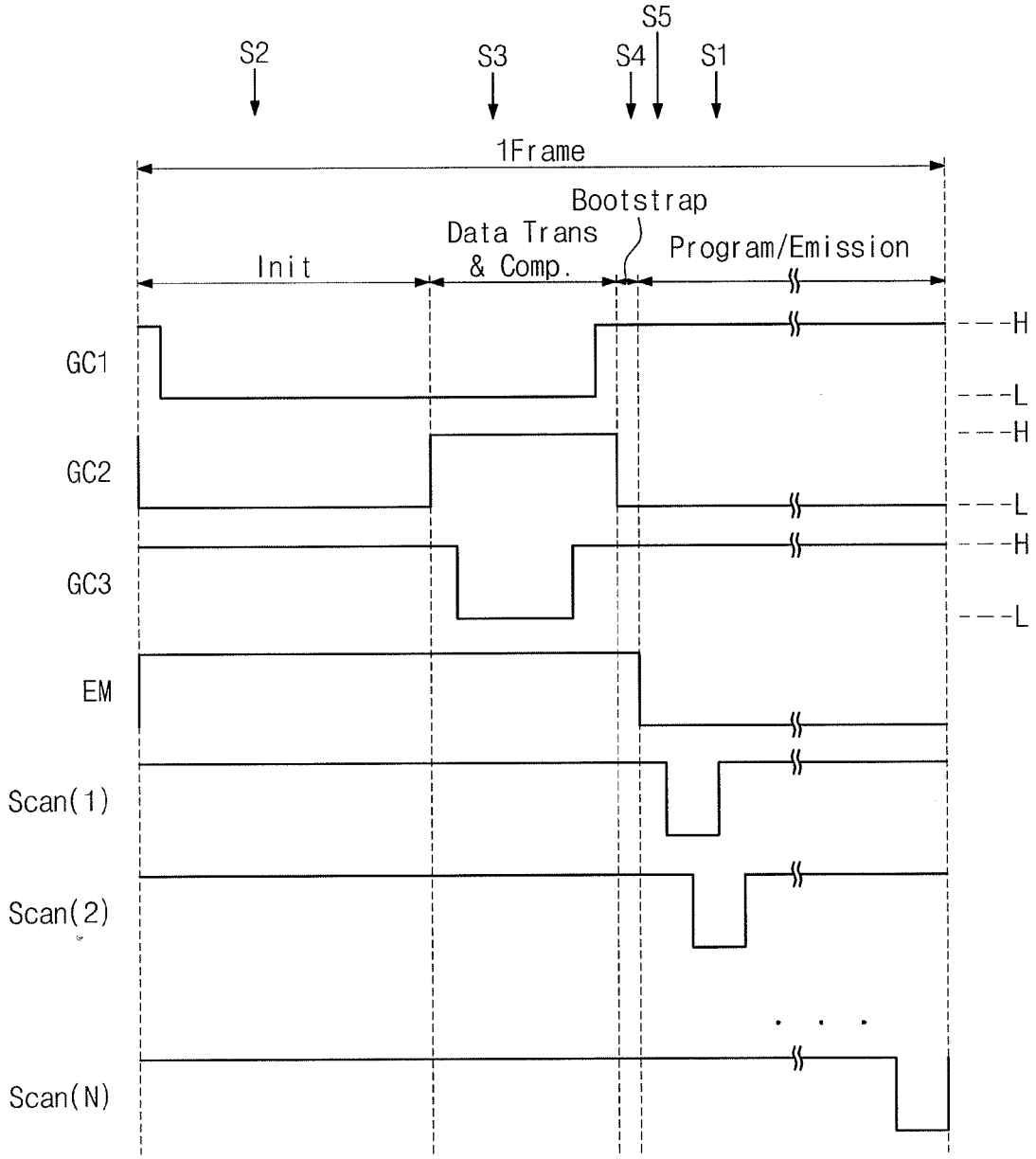
FIG. 18 illustrates an example of control signals for the pixel circuit in FIG. 17.

FIG. 17 illustrates another embodiment of a pixel circuit, and FIG. 18 is an example of a timing diagram illustrating control signals for this pixel circuit. In this embodiment, transistors 11 to 17 are P-channel MOSFETs. A modification or change on lines and signal patterns may be made such that transistors 11 to 17 in FIG. 17 perform the same or analogous functions as those in the first embodiment. As with the aforementioned embodiments of the pixel circuit, the pixel circuit of FIG. 17 may be included in the electro-optical device of FIG. 1 to form another device embodiment.

As illustrated in FIG. 17, the light-emitting switch transistor 12 and the driving transistor 11 are connected in series between a first power line P and an anode of the OLED 10. The gate of the light-emitting switch transistor 12 is electrically connected to a light-emitting switch driving line E. A connection node between the drain of the driving transistor 11 and the anode of the OLED 10 is electrically connected to a second power line W via a second initialization transistor 16. The gate of the second initialization transistor 16 is electrically connected to an initialization transistor driving line N.

A connection node between the source of the driving transistor 11 and the drain of the light-emitting switch transistor 12 is connected to the data line D via a first capacitor 31 and a first initialization transistor 14. The gate of the first initialization transistor 14 is electrically connected to the initialization transistor driving line N.

The bootstrap switch transistor 17 is connected between a gate of the driving transistor 11 and a connection node between the first capacitor 31 and the first initialization transistor 14. The gate of the bootstrap switch transistor 17 is connected to a bootstrap switch driving line G.

The gate of the driving transistor 11 is also connected to the second power line W via a transfer switch transistor 13 and a second capacitor 32. The gate of the transfer switch transistor 13 is connected to the transfer switch driving line I. The connection node between the transfer switch transistor 13 and the second capacitor 32 is connected to the data line D via a scan transistor 15. The gate of the scan transistor 15 is connected to the scan line S.

The control circuit 2 controls a driving circuit of FIG. 17 based on the timing diagram, such as shown, for example, in FIG. 18. The following procedure may be iterated whenever a gray scale voltage generation unit 22 generates a gray scale voltage of a frame unit by a period synchronized with a vertical synchronization signal.

At time S1 in FIG. 18, the control circuit 2 sets a potential of a first initialization transistor driving signal GC1 to H (e.g., a first initialization transistor 14 is turned off and a second initialization transistor 16 is turned off), a potential of a bootstrap switch driving signal GC2 to L (e.g., a bootstrap switch transistor 17 is turned on), a potential of a transfer switch driving signal GC3 to H (e.g., a transfer switch transistor 13 is turned off), and a potential of a light-emitting switch driving signal EM to L (e.g., a light-emitting switch transistor 12 is turned on) with respect to a predetermined number (e.g., all) pixel rows.

With this condition, in the driving circuits of all OLEDs 10, the driving transistor 11 and the second capacitor 32 are electrically separated, the first capacitor 31 is floated, and the driving transistor 11 supplies current to the OLED 10 according to a voltage Vgs (=Vinit−Data+Vth) that the first capacitor 31 holds according to a gray scale voltage of a previous frame. The OLED 10 emits light with a luminance corresponding to the gray scale voltage.

At the same time, the control circuit 2 maintains a potential of the first scan signal Scan to H (e.g., a scan transistor 15 is turned off) with respect to the rest of pixel rows, except for a scan-target pixel row (e.g., a first pixel row at the beginning and switched into a next pixel row sequentially according to a horizontal synchronization signal). Also, the control circuit 2 switches the potential of the first scan signal Scan to L (e.g., the scan transistor 15 is turned on) with respect to the scan-target pixel row. At this time, the control circuit 2 supplies a gray scale voltage Data of the scan-target pixel row to the data line D, so the gray scale voltage Data is stored in the second capacitor 32. Also, as described above, because the transfer switch transistor 13 is turned off, the gray scale voltage Data does not influence a gate voltage of the driving transistor 11.

The control circuit 2 performs the above-described programming with respect to all pixel rows as sequentially switching a scan-target pixel row whenever a predetermined horizontal synchronization signal is received. Switching a scan-target pixel row into a next pixel row, the control circuit 2 sets the potential of the first scan signal Scan of a pixel row where programming ends to H (e.g., the scan transistor 15 is turned off). At this time, the gray scale voltage Data is maintained in first capacitor 31.

When programming on all pixel rows is completed, at time S2 in FIG. 18, the control circuit 2 may switch a voltage supplied to the data line D into the initialization voltage Vinit. Simultaneously, the control circuit 2 may set the potential of the scan signal to H (e.g., the scan transistor 15 is turned off) with respect to all pixel rows, the potential of the initialization transistor driving signal GC1 to L (e.g., the first and second initialization transistors 14 and 16 are turned on), and the potential of the light-emitting switch driving signal EM to H (e.g., the light-emitting switch transistor 12 is turned off).

In this case, the OLED 10 does not emit light (or is turned off) because the current from ELVDD is blocked by the light-emitting switch transistor 12. Also, the anode of the OLED 10 is reset to a reference voltage VST, and charge accumulated in the parasitic capacitance of the OLED 10 during light-emission of a previous frame is discharged. Thus, abnormal light-emitting caused when current flows into the OLED 10 is prevented, even when a value of a gray scale voltage Data corresponds to a black value.

At the same time, the gate potential of the driving transistor 11 is reset to the initialization voltage Vinit. The source potential of the driving transistor 11 floated has a value of (Vinit−Vth) (Vth being a threshold voltage of the driving transistor 11). That is, the driving transistor 11 is turned off. At this time, a voltage stored in the parasitic capacitance between the gate and source of the driving transistor 11 is Vth.

At time S3 in FIG. 18, the control circuit 2 switches the potential of the bootstrap switch driving signal GC2 to H (e.g., the bootstrap switch transistor 17 is turned off) and a potential of the transfer switch driving signal GC3 to L (e.g., the transfer switch transistor 13 is turned on) with respect to all pixel rows. In this case, in the driving circuits of all OLEDs 10, the gray scale voltage Data stored in the second capacitor 32 is applied to the gate of the driving transistor 11 via the transfer switch transistor 13. At this time, the driving transistor 11 is instantly turned on, because the voltage Vth is stored in the parasitic capacitance between the gate and the source of the driving transistor 11 as described above.

In this case, the driving transistor 11 operates as a source follower circuit, current flows from VST through the second initialization transistor 16, the driving transistor 11, the first capacitor 31, and the first initialization transistor 14, and a source voltage of the driving transistor 11 becomes (Data−Vth). At this time, a voltage (Vinit1−Data+Vth) is held in the first capacitor 31. That is, with the above-described operation, transfer of the gray scale voltage Data from the second capacitor 32 to the first capacitor 31 and Vth correction on a corresponding gray scale voltage Data are simultaneously performed through the driving transistor 11.

At time S4 in FIG. 18, the control circuit 2 sets the potential of the first initialization transistor driving signal GC1 to H (e.g., the first initialization transistor 14 is turned off and the second initialization transistor 16 is turned off), the potential of the power blocking signal GC2 to L (e.g., the bootstrap switch transistor 17 is turned on), and the potential of the transfer switch driving signal GC3 to H (e.g., the transfer switch transistor 13 is turned off) with respect to all pixel rows.

With this condition, in the driving circuits of all pixels, because the transfer switch transistor 13 is turned off, the second capacitor 32 is electrically separated from the gate of the driving transistor 11. Also, because the first initialization transistor 14 is turned off and the bootstrap switch transistor 17 is turned on, the driving transistor 11 is bootstrapped and a voltage (Vinit−Data+Vth) held in the first capacitor 31 is applied between the gate and source of the driving transistor 11. Charge sharing does not matter because parasitic capacitance between the gate and the source of the driving transistor 11 is greater than capacitance of the first capacitor 31, and a gate-source voltage Vgs of the driving transistor 11 is (Vinit−Data+Vth).

At time S5 in FIG. 18, the control circuit 2 switches the potential of the light-emitting switch driving signal EM to L (e.g., the light-emitting switch transistor 12 is turned on) with respect to all pixel rows. In this case, current proportional to a voltage (Vinit−Data) dropped by a threshold voltage Vth from the gate-source voltage Vgs (=Vinit−Data+Vth) flows through the driving transistor 11 to control the OLED 10 to emit light. The luminance of the OLED 10 depends on a value of the gray scale voltage Data. Afterwards, the control circuit 2 executes an operation following S1 to receive a next gray scale voltage for controlling the OLED 10 to continue to emit light.

By way of summation and review, the threshold voltages of the driving transistors in the pixels of an electro-optical device may be irregular. Thus, even when the same gray scale voltage is applied to gates of the driving transistors, the amount of current supplied to respective OLEDs is often different from each other. Consequently, the luminance of light emitted from the OLEDs will differ from each other.

Various techniques have been proposed in an attempt to compensate for these effects. One technique involves supplying current of an intensity proportional to a gray scale voltage to an OLED, regardless of the unevenness threshold voltages of the pixels. This is accomplished by applying the unevenness of a threshold voltage of a driving transistor to a voltage Vgs applied between a gate and a source of the driving transistor according to a gray scale voltage. Applying unevenness of a threshold voltage to the voltage Vgs is referred to as threshold voltage (Vth) correction (or compensation).

Also, according to this technique, applying the gate voltage accompanying Vth correction is performed by configuring a source follower circuit. In such a circuit, a capacitor for holding the voltage Vgs is connected between the gate and the source of the driving transistor and a voltage corresponding to a threshold voltage Vth is written at the capacitor to overlap the gray scale data (data input) prior to a period where the driving transistor supplies current to an OLED. Thus, a Vth correction period, a data input period, and a period where the OLED emits light are continued in a time sequential manner for each OLED.

One proposed technique controls an execution order of the Vth correction and the data input on all OLEDs constituting a display. According to this technique, an image is displayed in an interlaced or progressive manner, and Vth correction and data input on OLEDs for respective colors of pixels in a display-target row are executed at the beginning of each horizontal scan period. In a simultaneous light-emitting driving technique, where images of all pixel rows are displayed at the same time, Vth correction and data input on all pixel rows are executed before image display.

In performing Vth correction and data input in the progressive manner disclosed above, when a frame rate is increased in order to increase the resolution of a display or to improve display performance of a moving picture, one horizontal scan period may become shorter. In this case, because it is difficult to secure sufficient time to perform Vth correction and data input, the luminance of an image may change.

Figure 19:
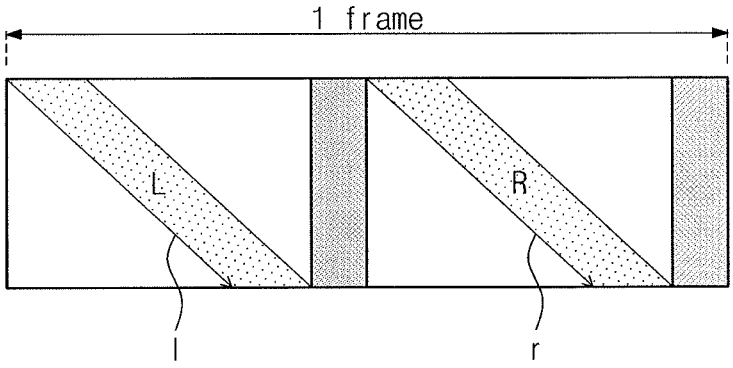
FIG. 19 (RELATED ART)
FIG. 19 illustrates a related-art method of progressive driving of a pixel circuit in a frame-sequential manner in a three-dimensional display.

For example, as illustrated in FIG. 19, in a three-dimensional display controlled in a frame-sequential manner, the display must be turned off throughout a transition period where left-eye and right-eye shutters are simultaneously opened and closed to prevent crosstalk. Operating in this frame-sequential manner, through interworking between a liquid crystal shutter glasses and a display, a right-eye image is expressed on the display while a field of vision for the left eye is blocked. Also, a left-eye image is expressed on the display while a field of vision for the right eye is blocked.

In FIG. 19, the abscissa corresponds to an elapsed time and the ordinate corresponds to a row of a display. A portion marked by a dark color indicates a transition period where left-eye and right-eye shutters are simultaneously opened and closed.

The arrow I indicates timing when Vth correction and the data input begin with respect to OLEDs of each row to display a left-eye image. A period L marked by dots indicates a light-emitting period of each row where a left-eye image is displayed. End points of light-emitting periods are dislocated (or, not matched), such that brightness is not changed on the whole screen by making light-emitting times of respective rows uniform.

The arrow r indicates a timing when Vth correction and data input begin with respect to OLEDs of each row to display a right-eye image. The period R marked by dots indicates a light-emitting period of each row where a right-eye image is displayed.

When operating in a three-dimensional display in a frame-sequential manner using Vth correction and data input for the progressive control, the time when Vth correction and data input are performed becomes much shorter. When the light-emitting time is shortened, the luminance of the OLED may need to be increased to improve the brightness of an image in external appearance. However, if a large amount of current is instantly supplied to the OLED, the light-emitting life time of the OLED may be shortened.

Another proposed technique involves performing Vth correction and data input for simultaneous light-emitting driving. According to this technique, Vth correction is performed with respect to all pixel circuits at the same time. Even though the time for Vth correction becomes long, it is possible to somewhat secure a horizontal scan period in which data input is performed with respect to each row. By performing Vth correction in this way, even though a three-dimensional image is displayed in the frame-sequential way, it is possible to perform the Vth correction during a period where left and right shutters are closed at the same time.

Figure 20:
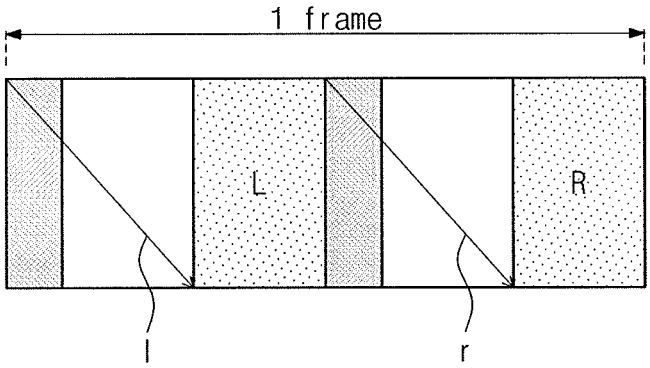
FIG. 20 (RELATED ART)
FIG. 20 illustrates a related-art method of simultaneous driving of a pixel circuit in a frame-sequential manner of a three-dimensional display.

Otherwise, as illustrated in FIG. 20, data input must be performed during a non-light-emitting period, even in Vth correction and data input is performed for simultaneous light-emitting driving. In FIG. 20, the abscissa corresponds to an elapsed time and the ordinate corresponds to a row of a display. A portion marked by a dark color indicates a transition period in which left-eye and right-eye shutters are simultaneously opened and closed.

The arrow I indicates a timing when Vth correction and data input begins for OLEDs of each row to display a left-eye image (thus, Vth correction and data input on some rows begin during the transition period). The period L marked by dots indicates a light-emitting period of each row where a left-eye image is displayed.

The arrow r indicates a timing when Vth correction and data input begin for OLEDs of each row to display a right-eye image. The period R marked by dots indicates a light-emitting period of each row where a right-eye image is displayed. The problem with the Vth correction and the data input for simultaneous light-emitting driving is that a data input period or a light-emitting period is short.

In accordance with one or more of the aforementioned embodiments, input of gray scale data for a next image and Vth correction of a driving transistor may be performed during a light-emission period of an OLED. Thus, it is possible to secure a sufficiently long light-emitting period and a period for performing data input and Vth correction.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An electro-optical device, comprising:

a driving transistor connected between a power supply and an electrode of a light-emitting element;

a first capacitor connected between a gate and a source of the driving transistor, the driving transistor to adjust current from the power supply based on a voltage stored in the first capacitor, the adjusted current to be supplied to the light-emitting element;

a second capacitor to store a gray scale voltage;

a switching circuit to selectively connect the first capacitor and the second capacitor to the gate of the driving transistor; and a control circuit to apply the gray scale voltage to the second capacitor while the first capacitor is connected to the gate of the driving transistor by the switching circuit, and to write a source voltage of the driving transistor at the first capacitor while the second capacitor is connected to the gate of the driving transistor by the switching circuit.

2. The device as claimed in claim 1, wherein the switching circuit includes:

a first switching transistor connected between the second capacitor and the gate of the driving transistor; and a second switching transistor connected between the first capacitor and the gate of the driving transistor.

3. The device as claimed in claim 1, further comprising:

a third switching transistor connected between a data line and an electrode of the second capacitor, wherein:

the data line is to receive the gray scale voltage from the control circuit, and the third switching transistor is to apply the gray scale voltage to the second capacitor when turned on by the control circuit.

4. The device as claimed in claim 1, further comprising:

a fourth switching transistor connected between a signal line and an electrode of the first capacitor adjacent to the gate of the driving transistor, the signal line is to be supplied with a voltage lower than a voltage of the power supply, and the fourth switching transistor is to write the source voltage of the driving transistor at the first capacitor when turned on by the control circuit.

5. The device as claimed in claim 1, further comprising:

a fifth switching transistor connected between the driving transistor and the light-emitting element, wherein the fifth switching transistor is to connect the first capacitor to the gate of the driving transistor when turned on by the control circuit.

6. A pixel circuit, comprising:

a driving transistor;

a first capacitor to store a first voltage; and a second capacitor to store a second voltage, wherein the first capacitor is selectively coupled to a gate of the driving transistor to store the first voltage when the second capacitor is not connected to the gate of the driving transistor, and wherein the second capacitor is selectively coupled to the gate of the driving transistor to store the second voltage when the first capacitor is not connected to the gate of the driving transistor.

7. The circuit as claimed in claim 6, wherein:

the first voltage is based on a gate-source voltage of the driving transistor, and the second voltage is based on a data voltage.

8. The circuit as claimed in claim 6, wherein the second voltage is transferred from the second capacitor to the first capacitor through a node connected to the gate of the driving transistor.

9. The circuit as claimed in claim 8, wherein the second voltage is transferred to the first capacitor during a time when threshold voltage correction for the driving transistor is simultaneously performed.

10. The circuit as claimed in claim 6, wherein the second capacitor stores a third voltage when the driving transistor is to control current to a light emitter based on the first voltage stored in the first capacitor.

11. The circuit as claimed in claim 6, wherein:

the second voltage is a data voltage for a first frame, and the third voltage is a data voltage for a second frame after the first frame.

12. The circuit as claimed in claim 6, wherein the first capacitor is connected between the gate and another terminal of the driving transistor.

13. The circuit as claimed in claim 12, wherein:

a first terminal of the first capacitor is coupled to a source of the driving transistor, and a second terminal of the first capacitor is coupled to a node, the node is coupled to the gate of the driving transistor, and the node is coupled to receive an initialization voltage.

14. The circuit as claimed in claim 13, wherein:

the initialization voltage is received from a signal line carrying a data voltage and the initialization voltage, and the second voltage is based on the data voltage.

15. The circuit as claimed in claim 6, wherein the first capacitor is connected between the gate of the driving transistor and a signal line to supply a reference voltage.

16. The circuit as claimed in claim 6, wherein:

the driving transistor is connected between a power supply line and a light emitter, and the first and second capacitors are selectively connected to the gate of the driving transistor independent from the power supply line.

17. An apparatus, comprising:

an interface; and a controller to generate a first signal to selectively connect a first capacitor to a gate of a driving transistor when a second capacitor is not connected to the gate, and to generate a second signal to selectively connect the second capacitor to the gate of the driving transistor when the first capacitor is not connected to the gate, and wherein the interface is connected between the controller and a pixel circuit which includes the driving transistor and the first and second transistors.

18. The apparatus as claimed in claim 17, wherein:

the first capacitor is to store a first voltage based on a gate-source voltage of the driving transistor, and the second capacitor is to store a second voltage based on a data voltage.

19. The apparatus as claimed in claim 17, wherein:

the first signal controls a first switch between the first capacitor and the gate of the driving transistor, and the second signal controls a second switch between the second capacitor and the gate of the driving transistor.

20. The apparatus as claimed in claim 17, wherein the first control signal and the second control signal are to have values to control transfer of a voltage from the second capacitor to the first capacitor during a time when threshold voltage correction for the driving transistor is to be simultaneously performed.

* * * * *